US011830437B2

(12) United States Patent
Yokoyama et al.

(10) Patent No.: US 11,830,437 B2
(45) Date of Patent: Nov. 28, 2023

(54) DISPLAY DEVICE

(71) Applicant: Sharp Kabushiki Kaisha, Sakai (JP)

(72) Inventors: Makoto Yokoyama, Sakai (JP); Nobuyuki Taya, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 18/014,493

(22) PCT Filed: Jul. 17, 2020

(86) PCT No.: PCT/JP2020/027907
§ 371 (c)(1),
(2) Date: Jan. 5, 2023

(87) PCT Pub. No.: WO2022/014051
PCT Pub. Date: Jan. 20, 2022

(65) Prior Publication Data
US 2023/0222981 A1 Jul. 13, 2023

(51) Int. Cl.
*G09G 3/3266* (2016.01)

(52) U.S. Cl.
CPC ... *G09G 3/3266* (2013.01); *G09G 2300/0852* (2013.01); *G09G 2310/0283* (2013.01); *G09G 2310/0286* (2013.01)

(58) Field of Classification Search
CPC ..... G09G 3/3266; G09G 2300/0852; G09G 2310/0283; G09G 2310/0286; G09G 3/20
See application file for complete search history.

(56) References Cited

U.S. PATENT DOCUMENTS 6,418,182 B1 7/2002 Suyama et al.
7,120,221 B2 * 10/2006 Moon ..... G11C 19/184 377/79

(Continued)

FOREIGN PATENT DOCUMENTS

JP 11-176186 A 7/1999
JP 11-213686 A 8/1999

(Continued)

OTHER PUBLICATIONS

Official Communication issued in International Patent Application No. PCT/JP2020/027907, dated Sep. 24, 2020.

*Primary Examiner* — Bryan Earles
(74) *Attorney, Agent, or Firm* — KEATING & BENNETT, LLP

(57) ABSTRACT

Narrowing of a picture-frame of a display device that can perform switching between vertical scanning directions is implemented. A gate driver (21) includes a shift register (211) including a plurality of unit circuits including n unit circuits connected to write control lines; a first scanning order switching circuit (212) including a plurality of first switching circuits respectively corresponding to the plurality of unit circuits; and a second scanning order switching circuit (213) including n second switching circuits connected to initialization control lines. The first scanning order switching circuit (212) controls operation of the shift register (211) based on scanning order instruction signals. Each second switching circuit applies, based on the scanning order instruction signals, an output signal from a unit circuit on a previous stage side or an output signal from a unit circuit on a subsequent stage side, as a second scanning signal, to an initialization control line.

10 Claims, 22 Drawing Sheets

(56) References Cited

U.S. PATENT DOCUMENTS

| | | | | |
|---|---|---|---|---|
| 2006/0210012 | A1* | 9/2006 | Yamaguchi | G11C 19/00 377/64 |
| 2009/0167668 | A1 | 7/2009 | Kim | |
| 2015/0262703 | A1 | 9/2015 | Murakami et al. | |
| 2018/0181243 | A1* | 6/2018 | Tsunashima | G06F 3/0412 |
| 2019/0355304 | A1 | 11/2019 | Tanaka et al. | |
| 2020/0082765 | A1 | 3/2020 | Zhang et al. | |

FOREIGN PATENT DOCUMENTS

| | | | |
|---|---|---|---|
| JP | 2009-163862 | A | 7/2009 |
| WO | 2014/054516 | A1 | 4/2014 |
| WO | 2019/053769 | A1 | 3/2019 |

* cited by examiner

DISPLAY DEVICE

TECHNICAL FIELD

The following disclosure relates to a display device including a scanning line drive circuit that can perform switching between vertical scanning directions.

BACKGROUND ART

In recent years, an organic EL display device including pixel circuits each including an organic EL element has been put to practical use. The organic EL element is also called an organic light-emitting diode (OLED), and is a self-emissive display element that emits light at luminance depending on a current flowing therethrough. As such, since the organic EL element is a self-emissive display element, the organic EL display device can easily achieve slimming down, a reduction in power consumption, an increase in luminance, etc., compared to a liquid crystal display device that requires a backlight, a color filter, and the like. Thus, in recent years, development of organic EL display devices has been actively pursued.

In a display unit of an organic EL display device there are disposed various types of control signal lines for controlling operation of pixel circuits. For example, in an organic EL display device that adopts an internal compensation scheme as a scheme for compensating for variations in characteristics of drive transistors in pixel circuits, there are disposed, in a display unit, a plurality of types of horizontal scanning lines such as write control lines for controlling writing of data signals to the pixel circuits, and initialization control lines for initializing the states of the inside of the pixel circuits.

Note that in this specification, sequential scanning of the horizontal scanning lines from an upper edge side of the display unit to a lower edge side of the display unit is referred to as "normal order scanning", and sequential scanning of the horizontal scanning lines from the lower edge side of the display unit to the upper edge side of the display unit is referred to as "reverse order scanning".

The following takes a look at a case in which the above-described write control lines and initialization control lines are provided as a plurality of types of horizontal scanning lines. Writing of a data signal to a pixel circuit is performed after initialization of an internal state of the pixel circuit. Thus, when taking a look at a write control line and an initialization control line that are connected to pixel circuits in the same row, the initialization control line becomes active at earlier timing than timing at which the write control line becomes active (an on-level scanning signal is applied to the initialization control line at earlier timing than timing at which an on-level scanning signal is applied to the write control line). In this case, a write control line connected to pixel circuits in a given row and an initialization control line connected to pixel circuits in a different row than the given row can be made active at the same timing. In this regard, if a vertical scanning direction (scanning order of the plurality of horizontal scanning lines) is fixed to one direction (e.g., if only normal order scanning is performed) throughout a period during which the organic EL display device operates, then a write control line and an initialization control line that are to become active at the same timing can be collectively driven, which can be implemented by a shift register of one system. However, in a case of adopting a configuration in which switching between vertical scanning directions (switching between normal order scanning and reverse order scanning) can be performed, a combination of a write control line and an initialization control line that are to become active at the same timing differs between when normal order scanning is performed and when reverse order scanning is performed. Hence, there are required a shift register for driving the write control lines and a shift register for driving the initialization control lines. That is, there are required shift registers of two systems.

FIG. 17 is a block diagram showing a schematic configuration of a gate driver 9 including the above-described shift registers of two systems. The gate driver 9 includes a scanning driver 91 that drives write control lines; and a discharge driver 92 that drives initialization control lines. The scanning driver 91 is constituted of a shift register 911 connected to a plurality of write control lines in a display unit; and a scanning order switching circuit 912 for switching vertical scanning directions. The discharge driver 92 is constituted of a shift register 921 connected to a plurality of initialization control lines in the display unit; and a scanning order switching circuit 922 for switching the vertical scanning directions.

FIGS. 18 and 19 are block diagrams showing detailed configurations of the gate driver 9 shown in FIG. 17. FIG. 18 shows configurations of portions of the shift registers 911 and 921 near their initial stage sides, and FIG. 19 shows configurations of portions of the shift registers 911 and 921 near their last stage sides. A circuit that forms each stage of the shift register is hereinafter referred to as "unit circuit". Note that here it is assumed that n write control lines SCAN(1) to SCAN(n) and n initialization control lines DIS(1) to DIS(n) are disposed in the display unit.

As described above, the gate driver 9 includes the scanning driver 91 and the discharge driver 92. The scanning driver 91 is constituted of the shift register 911 including (n+2) unit circuits U1(0) to U1(n+1); and the scanning order switching circuit 912 including (n+2) switching circuits S1 having one-to-one correspondence with the (n+2) unit circuits U1(0) to U1(n+1). The discharge driver 92 is constituted of the shift register 921 including (n+2) unit circuits U2(0) to U2(n+1); and the scanning order switching circuit 922 including (n+2) switching circuits S2 having one-to-one correspondence with the (n+2) unit circuits U2(0) to U2(n+1). For the shift register 911, the unit circuits U1(1) to U1(n) are connected to the write control lines SCAN(1) to SCAN(n) in the display unit, whereas the unit circuits U1(0) and U1(n+1) are connected to dummy write control lines SCAN(DUa) and SCAN(DUb). Likewise, for the shift register 921, the unit circuits U2(1) to U2(n) are connected to the initialization control lines DIS(1) to DIS(n) in the display unit, whereas the unit circuits U2(0) and U2(n+1) are connected to dummy initialization control lines DIS(DUa) and DIS(DUb).

Various types of control signals are provided to the scanning driver 91 and the discharge driver 92 as follows. Gate clock signals GCK1 and GCK2 which are two-phase clock signals and scanning order instruction signals UD and UDB that indicate vertical scanning directions are provided to the scanning driver 91 and the discharge driver 92. In addition, a gate start pulse signal GSP(S) is provided to the scanning driver 91, and a gate start pulse signal GSP(D) is provided to the discharge driver 92. Note that the gate start pulse signal GSP(S) is provided to a switching circuit S1 corresponding to the unit circuit U1(0) and a switching circuit S1 corresponding to the unit circuit U1(n+1), and the gate start pulse signal GSP(D) is provided to a switching circuit S2 corresponding to the unit circuit U2(0) and a switching circuit S2 associated with the unit circuit U2(n+1).

The switching circuits S1 and S2 are configured as follows. When a first selection signal SEL is at high level and a second selection signal SELB is at low level, a first input signal IN1 is outputted as an output signal OUT. When the first selection signal SEL is at low level and the second selection signal SELB is at high level, a second input signal IN2 is outputted as the output signal OUT. Note that to the switching circuits S1 and S2 there are provided the scanning order instruction signal UD as the first selection signal SEL, and the scanning order instruction signal UDB as the second selection signal SELB.

The unit circuits U1(0) to U1(n+1) in the shift register 911 and the unit circuits U2(0) to U2(n+1) in the shift register 921 are configured as follows. When a first clock signal CK1 is at low level, a set input signal IN is captured inside. If the set input signal IN is at low level (on level), then the next time a second clock signal CK2 changes from high level to low level, a low-level (on-level) output signal OUT is outputted.

FIGS. 20 and 21 are signal waveform diagrams obtained when normal order scanning is performed. When normal order scanning is performed, the scanning order instruction signal UD is maintained at high level and the scanning order instruction signal UDB is maintained at low level. After a pulse of the gate start pulse signal GSP(D) is provided to the discharge driver 92, a pulse of the gate start pulse signal GSP(S) is provided to the scanning driver 91. By this, the first initialization control line DIS(1) to the nth initialization control line DIS(n) sequentially become active and the first write control line SCAN(1) to the nth write control line SCAN(n) sequentially become active. At that time, with k being a natural number between 1 and (n−1), inclusive, a kth write control line SCAN(k) and a (k+1)th initialization control line DIS(k+1) become active at the same timing.

FIGS. 22 and 23 are signal waveform diagrams obtained when reverse order scanning is performed. When reverse order scanning is performed, the scanning order instruction signal UD is maintained at low level and the scanning order instruction signal UDB is maintained at high level. After a pulse of the gate start pulse signal GSP(D) is provided to the discharge driver 92, a pulse of the gate start pulse signal GSP(S) is provided to the scanning driver 91. By this, the nth initialization control line DIS(n) to the first initialization control line DIS(1) sequentially become active and the nth write control line SCAN(n) to the first write control line SCAN(1) sequentially become active. At that time, with k being a natural number between 2 and n, inclusive, a kth write control line SCAN(k) and a (k−1)th initialization control line DIS(k−1) become active at the same timing.

As described above, in an organic EL display device having a display unit in which two types of horizontal scanning lines (write control lines and initialization control lines) are disposed, by adopting a configuration in which those two types of horizontal scanning lines are driven using shift registers of two systems, switching between vertical scanning directions is implemented.

Note that in relation to this application, the following related art documents are known. Japanese Laid-Open Patent Publication No. H11-176186 discloses an invention of a liquid crystal display device including a bidirectional shift register. In addition, Japanese Laid-Open Patent Publication No. H11-213686 discloses an invention of a bidirectional shift register that can implement a bidirectional shift function with a small number of elements.

PRIOR ART DOCUMENTS

Patent Documents

[Patent Document 1] Japanese Laid-Open Patent Publication No. H11-176186

[Patent Document 2] Japanese Laid-Open Patent Publication No. H11-213686

SUMMARY

Problems to be Solved by the Invention

In recent years, there has been an increasing demand for an increase in definition and miniaturization of a display device. However, in a case of adopting a configuration in which switching between vertical scanning directions can be performed, according to the known technique, shift registers whose number corresponds to the number of types of horizontal scanning lines disposed in a display unit need to be provided in a gate driver (a circuit for driving the horizontal scanning lines). Hence, the circuit size significantly increases compared to a configuration in which the horizontal scanning lines are driven using a shift register of one system. Therefore, if switching between vertical scanning directions is made possible, then a picture-frame region is naturally widened. When the picture-frame region is thus widened, it becomes difficult to implement an increase in definition and miniaturization of the display device.

An object of the following disclosure is therefore to implement narrowing of a picture-frame of a display device that can perform switching between vertical scanning directions (scanning order of a plurality of horizontal scanning lines).

Means for Solving the Problems

A display device according to some embodiments of the present disclosure is a display device including pixel circuits each including a display element driven by a current, the display device including:

a display unit including n first scanning lines; m data signal lines; n×m pixel circuits provided corresponding to intersections of the n first scanning lines and the m data signal lines; and n second scanning lines having one-to-one correspondence with the n first scanning lines, the n and m being natural numbers;

a scanning line drive circuit configured to apply a first scanning signal to the n first scanning lines and apply a second scanning signal to the n second scanning lines, based on scanning order instruction signals that indicate scanning order of the n first scanning lines and the n second scanning lines; and a data signal line drive circuit configured to apply a data signal to the m data signal lines, wherein the scanning line drive circuit includes:

a shift register including a plurality of unit circuits including n unit circuits respectively connected to the n first scanning lines; one or more unit circuits provided at a previous stage side of the n unit circuits; and one or more unit circuits provided at a subsequent stage side of the n unit circuits;

a plurality of first switching circuits respectively corresponding to the plurality of unit circuits; and n second switching circuits respectively connected to the n second scanning lines, with K being a natural number, a first switching circuit corresponding to a unit circuit connected to a Kth first scanning line provides, based on the scanning order instruction signals, an output signal from a unit circuit connected to a (K−1)th first scanning line or an output signal from a unit circuit connected to a (K+1)th first scanning line, as a set input signal, to the unit circuit connected to the Kth first scanning line, each of the unit circuits outputs an output signal based on the set input signal and a clock signal, to each of the first scanning lines there is applied, as the first scanning signal, an output signal from a unit circuit to which the each of the first scanning lines is connected, and with P and Q being natural numbers, a second switching circuit connected to a Pth second scanning line applies, based on the scanning order instruction signals, an output signal from a unit circuit connected to a (P−Q)th first scanning line or an output signal from a unit circuit connected to a (P+Q)th first scanning line, as the second scanning signal, to the Pth second scanning line.

Effects of the Invention

According to several embodiments of the present disclosure, the scanning line drive circuit is constituted of a shift register including a plurality of unit circuits including n unit circuits respectively connected to n first scanning lines; and switching circuits (a plurality of first switching circuits and n second switching circuits) that operate based on scanning order instruction signals. Each first switching circuit provides, based on the scanning order instruction signals, an output signal from a unit circuit on a previous stage side or an output signal from a unit circuit on a subsequent stage side, as a set input signal, to a corresponding unit circuit. That is, a bidirectional shift register is implemented by the shift register and the plurality of first switching circuits. Further, a second switching circuit connected to a Pth second scanning line applies, based on the scanning order instruction signals, an output signal from a unit circuit connected to a (P−Q)th first scanning line or an output signal from a unit circuit connected to a (P+Q)th first scanning line, as a second scanning signal, to the Pth second scanning line. By this, when normal order scanning is performed, a Pth first scanning line and a (P+Q)th second scanning line become active at the same timing, and when reverse order scanning is performed, the Pth first scanning line and a (P−Q)th second scanning line become active at the same timing. As a result, in each pixel circuit, regardless of a vertical scanning direction, a second scanning line to which the each pixel circuit is connected becomes active, and then a first scanning line to which the each pixel circuit is connected becomes active. That is, switching between vertical scanning directions is performed normally. A bidirectional shift register is implemented by the shift register and the plurality of first switching circuits as described above, and thus, by a configuration in which n switching circuits (second switching circuits) are added to the bidirectional shift register of one system, a display device including two types of scanning lines can perform switching between vertical scanning directions. From the above, narrowing of a picture-frame of the display device that can perform switching between vertical scanning directions (scanning order of a plurality of horizontal scanning lines) is implemented.

MODE FOR CARRYING OUT THE INVENTION

One embodiment will be described below with reference to the accompanying drawings.

<1. Overall Configuration and Summary of Operation>

Figure 2:
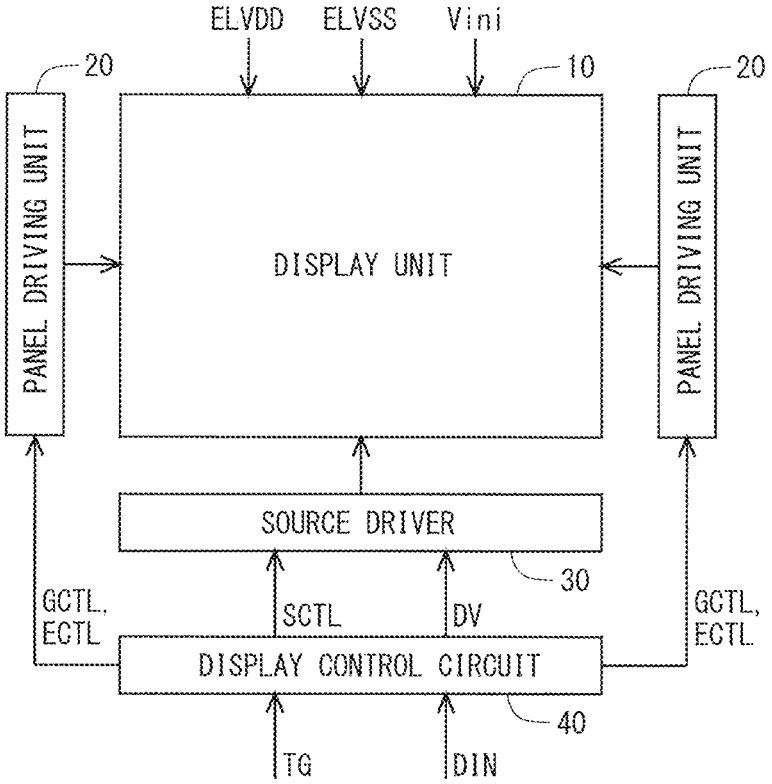
FIG. 2 is a block diagram showing an overall configuration of an organic EL display device according to the embodiment.

FIG. 2 is a block diagram showing an overall configuration of an organic EL display device of the present embodiment. As shown in FIG. 2, the organic EL display device includes a display unit 10, panel driving units 20, a source driver (data signal line drive circuit) 30, and a display control circuit 40. Note that although the panel driving units 20 are provided on both the left and right edge sides of the display unit 10 in an example shown in FIG. 2, a panel driving unit 20 may be provided only on one of the left and right edge sides of the display unit 10.

Figure 3:
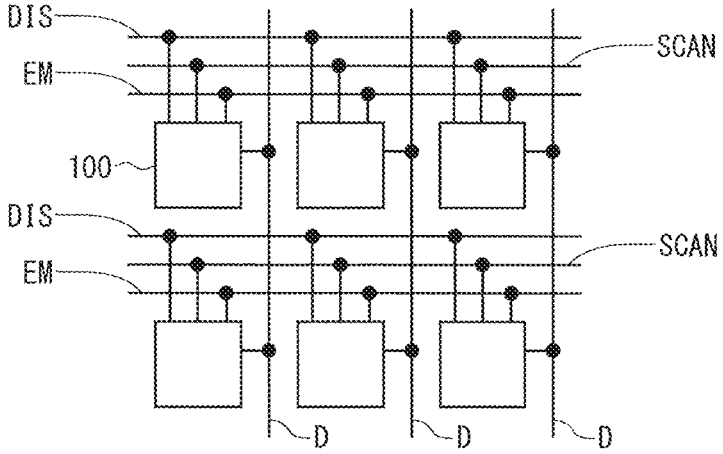
FIG. 3 is a diagram showing a configuration of a part of the inside of a display unit in the embodiment.

FIG. 3 is a diagram showing a configuration of a part of the inside of the display unit 10. The display unit 10 is provided with a plurality of pixel circuits 100. In addition, in the display unit 10 there are disposed a plurality of write control lines SCAN, a plurality of initialization control lines DIS, a plurality of light emission control lines EM, and a plurality of data signal lines D. The write control lines SCAN, the initialization control lines DIS, and the light emission control lines EM extend in a horizontal scanning direction, and the data signal lines D extend in a vertical scanning direction. In the following description, scanning signals that are provided to the write control lines SCAN (hereinafter, referred to as "first scanning signals") are also given reference character SCAN as necessary, scanning signals that are provided to the initialization control lines DIS (hereinafter, referred to as "second scanning signals") are also given reference character DIS as necessary, light emission control signals that are provided to the light emission control lines EM are also given reference character EM as necessary, and data signals that are provided to the data signal lines D are also given reference character D as necessary. Note that in the present embodiment, first scanning lines are implemented by the write control lines SCAN and second scanning lines are implemented by the initialization control lines DIS.

In addition, in the display unit 10 there are disposed power lines (not shown) that are shared between the plurality of pixel circuits 100. More specifically, there are disposed a power line that supplies a high-level power supply voltage ELVDD for driving organic EL elements (hereinafter, referred to as "high-level power line"), a power line that supplies a low-level power supply voltage ELVSS for driving the organic EL elements (hereinafter, referred to as "low-level power line"), and a power line that supplies an initialization voltage Vini (hereinafter, referred to as "initialization power line"). The high-level power supply voltage ELVDD, the low-level power supply voltage ELVSS, and the initialization voltage Vini are supplied from a power supply circuit which is not shown. Note that the high-level power line corresponds to a first power line and the low-level power line corresponds to a second power line.

Figure 4:
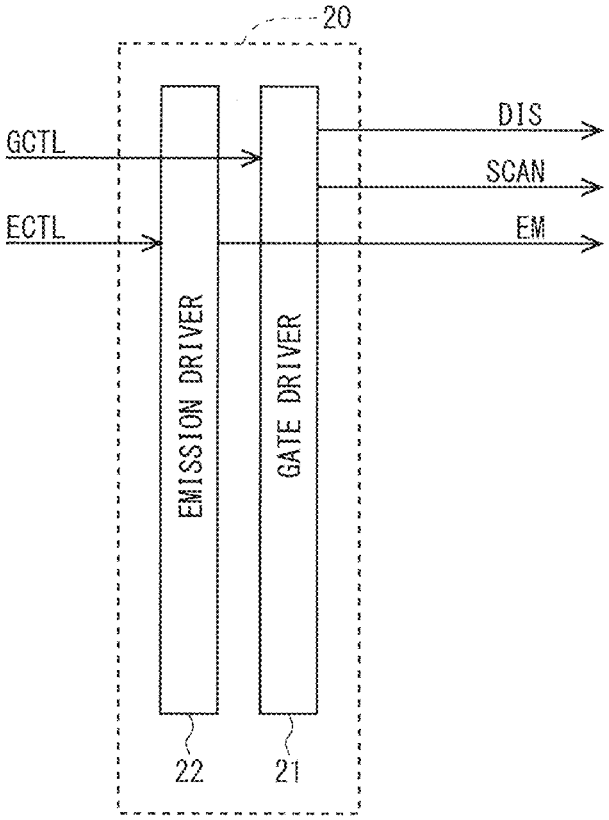
FIG. 4 is a block diagram showing a functional configuration of a panel driving unit in the embodiment.

FIG. 4 is a block diagram showing a functional configuration of the inside of the panel driving unit 20. As shown in FIG. 4, the panel driving unit 20 includes a gate driver (scanning line drive circuit) 21 that drives the write control lines SCAN and the initialization control lines DIS; and an emission driver 22 that drives the light emission control lines EM. Note that the panel driving unit 20 provided on the left edge side of the display unit 10 and the panel driving unit 20 provided on the right edge side of the display unit 10 have the same configuration, and thus, in this specification, description is made focusing on the panel driving unit 20 provided on the left edge side of the display unit 10.

Operation of each component shown in FIGS. 2 and 4 will be described below. The display control circuit 40 receives an input image signal DIN and a timing signal group (a horizontal synchronizing signal, a vertical synchronizing signal, etc.) TG that are transmitted from an external source, and outputs digital video signals DV, control signals GCTL that control operation of the gate driver 21 in the panel driving unit 20, control signals ECTL that control operation of the emission driver 22 in the panel driving unit 20, and control signals SCTL that control operation of the source driver 30.

The gate driver 21 in the panel driving unit 20 applies first scanning signals to the plurality of write control lines SCAN and applies second scanning signals to the plurality of initialization control lines DIS, based on the control signals GCTL outputted from the display control circuit 40. The gate driver 21 of the present embodiment is configured to enable switching between vertical scanning directions. A detailed description of the gate driver 21 will be made later. The emission driver 22 in the panel driving unit 20 applies light emission control signals to the plurality of light emission control lines EM, based on the control signals ECTL outputted from the display control circuit 40. The source driver 30 applies data signals to the plurality of data signal lines D, based on the digital video signals DV and control signals SCTL outputted from the display control circuit 40.

By applying the first scanning signals to the plurality of write control lines SCAN, applying the second scanning signals to the plurality of initialization control lines DIS, applying the light emission control signals to the plurality of light emission control lines EM, and applying the data signals to the plurality of data signal lines D in the above-described manner, an image based on the input image signal DIN is displayed on the display unit 10.

The following assumes that with n and m being natural numbers, in the display unit 10 there are disposed n write control lines SCAN(1) to SCAN(n), n initialization control lines DIS(1) to DIS(n), n light emission control lines EM(1) to EM(n), and m data signal lines D(1) to D(n). Thus, the display unit 10 includes n×m pixel circuits 100.

<2. Configuration and Operation of a Pixel Circuit>

Figure 5:
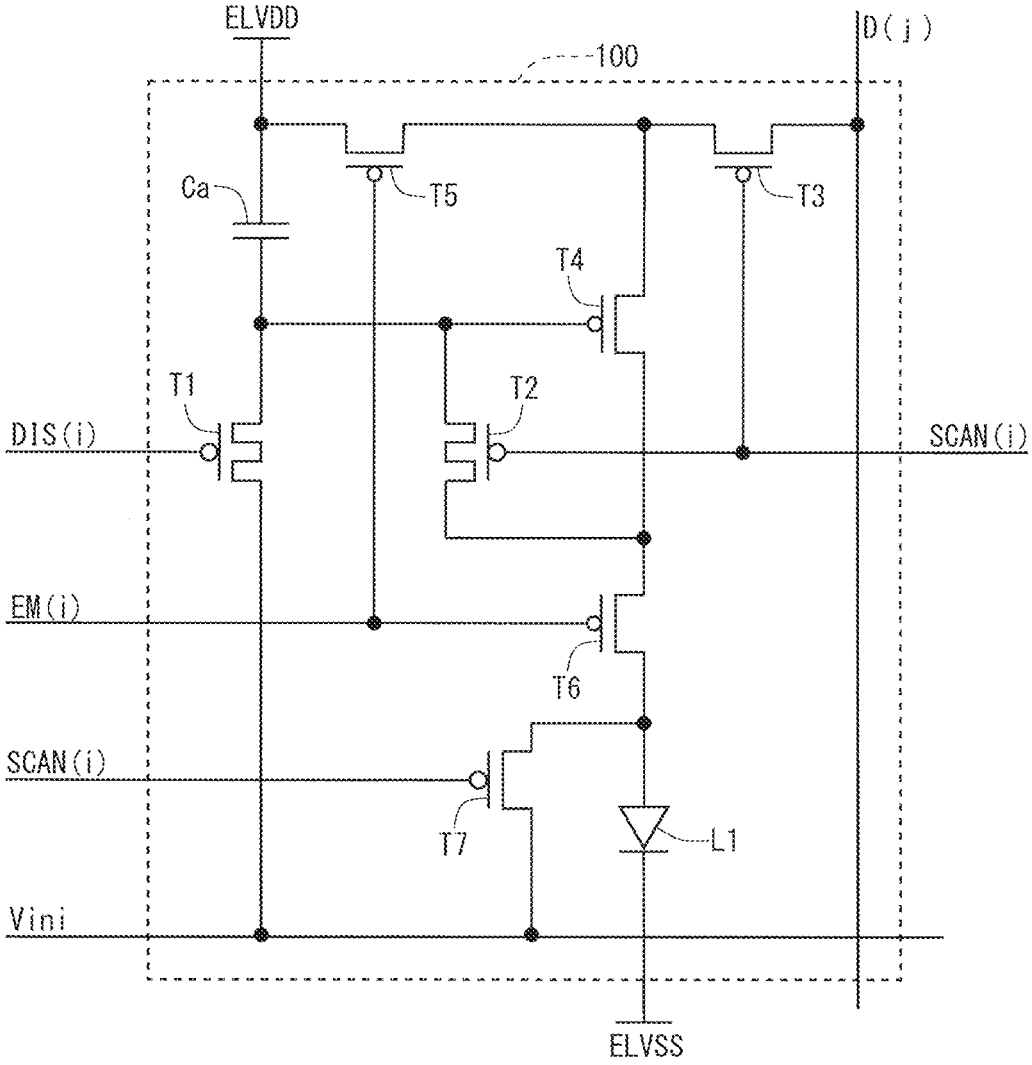
FIG. 5 is a circuit diagram showing a configuration of a pixel circuit in an ith row and a jth column in the embodiment.

Next, a configuration of a pixel circuit 100 in the display unit 10 will be described. FIG. 5 is a circuit diagram showing a configuration of a pixel circuit 100 in an ith row and a jth column. The pixel circuit 100 includes one organic EL element (organic light-emitting diode) L1 serving as a display element (a display element driven by a current); seven transistors (typically, thin-film transistors) T1 to T7 (a first initialization transistor T1, a threshold voltage compensation transistor T2, a write control transistor T3, a drive transistor T4, a power supply control transistor T5, a light emission control transistor T6, and a second initialization transistor T7); and one holding capacitor Ca. The holding capacitor Ca is a capacitive element including two electrodes (a first electrode and a second electrode). The transistors T1 to T7 are P-channel type transistors. The first initialization transistor T1 and the threshold voltage compensation transistor T2 have a dual-gate structure in which the two transistors are connected in series with each other. By adopting such a dual-gate structure, effects such as an improvement in breakdown voltage of the transistors and a reduction in off-current of the transistors can be obtained.

The first initialization transistor T1 is connected at its control terminal to an ith initialization control line DIS(i), connected at its first conductive terminal to a second conductive terminal of the threshold voltage compensation transistor T2, a control terminal of the drive transistor T4, and the second electrode of the holding capacitor Ca, and connected at its second conductive terminal to an initialization power line. The threshold voltage compensation transistor T2 is connected at its control terminal to an ith write control line SCAN(i), connected at its first conductive terminal to a second conductive terminal of the drive transistor T4 and a first conductive terminal of the light emission control transistor T6, and connected at its second conductive terminal to the first conductive terminal of the first initialization transistor T1, the control terminal of the drive transistor T4, and the second electrode of the holding capacitor Ca. The write control transistor T3 is connected at its control terminal to the ith write control line SCAN(i), connected at its first conductive terminal to a jth data signal line D(j), and connected at its second conductive terminal to a first conductive terminal of the drive transistor T4 and a second conductive terminal of the power supply control transistor T5. The drive transistor T4 is connected at its control terminal to the first conductive terminal of the first initialization transistor T1, the second conductive terminal of the threshold voltage compensation transistor T2, and the second electrode of the holding capacitor Ca, connected at its first conductive terminal to the second conductive terminal of the write control transistor T3 and the second conductive terminal of the power supply control transistor T5, and connected at its second conductive terminal to the first conductive terminal of the threshold voltage compensation transistor T2 and the first conductive terminal of the light emission control transistor T6.

The power supply control transistor T5 is connected at its control terminal to an ith light emission control line EM(i), connected at its first conductive terminal to the high-level power line and the first electrode of the holding capacitor Ca, and connected at its second conductive terminal to the second conductive terminal of the write control transistor T3 and the first conductive terminal of the drive transistor T4. The light emission control transistor T6 is connected at its control terminal to the ith light emission control line EM(i), connected at its first conductive terminal to the first conductive terminal of the threshold voltage compensation transistor T2 and the second conductive terminal of the drive transistor T4, and connected at its second conductive terminal to a first conductive terminal of the second initialization transistor T7 and an anode terminal of the organic EL element L1. The second initialization transistor T7 is connected at its control terminal to the ith write control line SCAN(i), connected at its first conductive terminal to the second conductive terminal of the light emission control transistor T6 and the anode terminal of the organic EL element L1, and connected at its second conductive terminal to the initialization power line. The holding capacitor Ca is connected at its first electrode to the high-level power line and the first conductive terminal of the power supply control transistor T5, and connected at its second electrode to the first conductive terminal of the first initialization transistor T1, the second conductive terminal of the threshold voltage compensation transistor T2, and the control terminal of the drive transistor T4. The organic EL element L1 is connected at its anode terminal (first terminal) to the second conductive terminal of the light emission control transistor T6 and the first conductive terminal of the second initialization transistor T7, and connected at its cathode terminal (second terminal) to the low-level power line.

Note that the configuration shown in FIG. 5 is an example and thus the configuration is not limited thereto. For example, a pixel circuit constituted of only N-channel type transistors can also be adopted. In addition, the first initialization transistor T1 and the threshold voltage compensation transistor T2 may not have a dual-gate structure. In addition, for example, a configuration in which the second initialization transistor T7 among the seven transistors T1 to T7 is not provided can also be adopted.

Figure 6:
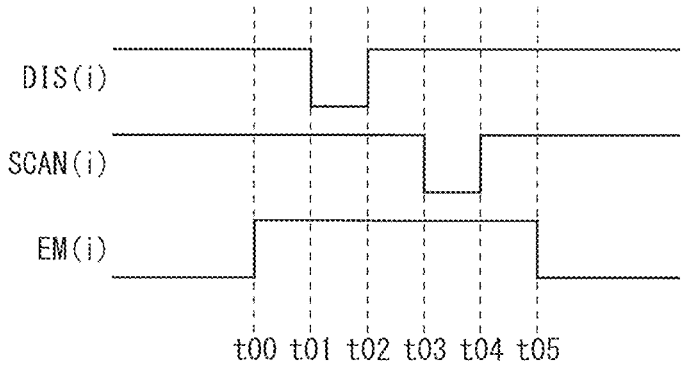
FIG. 6 is a timing chart for describing operation of the pixel circuit in the embodiment.

Next, operation of the pixel circuit 100 will be described. FIG. 6 is a timing chart for describing operation of the pixel circuit 100 in the ith row shown in FIG. 5. Note that for FIG. 6, a period before time t00 and a period after time t05 are light emission periods, and a period from time t00 to t05 is a turn-off period.

During a period earlier than time t00, the second scanning signal DIS(i) and the first scanning signal SCAN(i) are at high level, and the light emission control signal EM(i) is at low level. At this time, the power supply control transistor T5 and the light emission control transistor T6 are in on state, and the organic EL element L1 emits light depending on the magnitude of a drive current. The first initialization transistor T1, the threshold voltage compensation transistor T2, the write control transistor T3, and the second initialization transistor T7 are in off state.

At time t00, the light emission control signal EM(i) changes from low level to high level. By this, the power supply control transistor T5 and the light emission control transistor T6 go into off state. As a result, the supply of a current to the organic EL element L1 is interrupted, and the organic EL element L1 goes into turn-off state.

At time t01, the second scanning signal DIS(i) changes from high level to low level. By this, the first initialization transistor T1 goes into on state. As a result, the voltage at the control terminal of the drive transistor 14 is initialized. That is, the voltage at the control terminal of the drive transistor 14 becomes substantially equal to the initialization voltage Vini. At time t02, the second scanning signal DIS(i) changes from low level to high level. By this, the first initialization transistor T1 goes into off state.

At time t03, the first scanning signal SCAN(i) changes from high level to low level. By this, the threshold voltage compensation transistor T2, the write control transistor T3, and the second initialization transistor T7 go into on state. By the threshold voltage compensation transistor T2 and the write control transistor T3 going into on state, the data signal D(j) is provided to the second electrode of the holding capacitor Ca through the write control transistor T3, the drive transistor 14, and the threshold voltage compensation transistor T2. By this, the holding capacitor Ca is charged. In addition, by the second initialization transistor T7 going into on state, the anode voltage of the organic EL element L1 is initialized. That is, the anode voltage of the organic EL element L1 becomes substantially equal to the initialization voltage Vini. At time t04, the first scanning signal SCAN(i) changes from low level to high level. By this, the threshold voltage compensation transistor T2, the write control transistor T3, and the second initialization transistor T7 go into off state.

At time t05, the light emission control signal EM(i) changes from high level to low level. By this, the power supply control transistor T5 and the light emission control transistor T6 go into on state, and a drive current depending on the charged voltage in the holding capacitor Ca is supplied to the organic EL element L1. As a result, the organic EL element L1 emits light depending on the magnitude of the drive current. Thereafter, the organic EL element L1 emits light throughout a period until the next time the light emission control signal EM(i) changes from low level to high level.

As above, upon writing of a data signal D in each pixel circuit 100, after a second scanning signal DIS applied to a corresponding initialization control line is brought to low level (on level) for a predetermined period, a first scanning signal SCAN applied to a corresponding write control line is brought to low level (on level) for a predetermined period.

Note that the organic EL display device according to the present embodiment can perform switching between vertical scanning directions, and both upon performing normal order scanning and upon performing reverse order scanning, the pixel circuit 100 operates in the same manner.

<3. Gate Driver>

<3.1 Overall Configuration of the Gate Driver>

Figure 1:
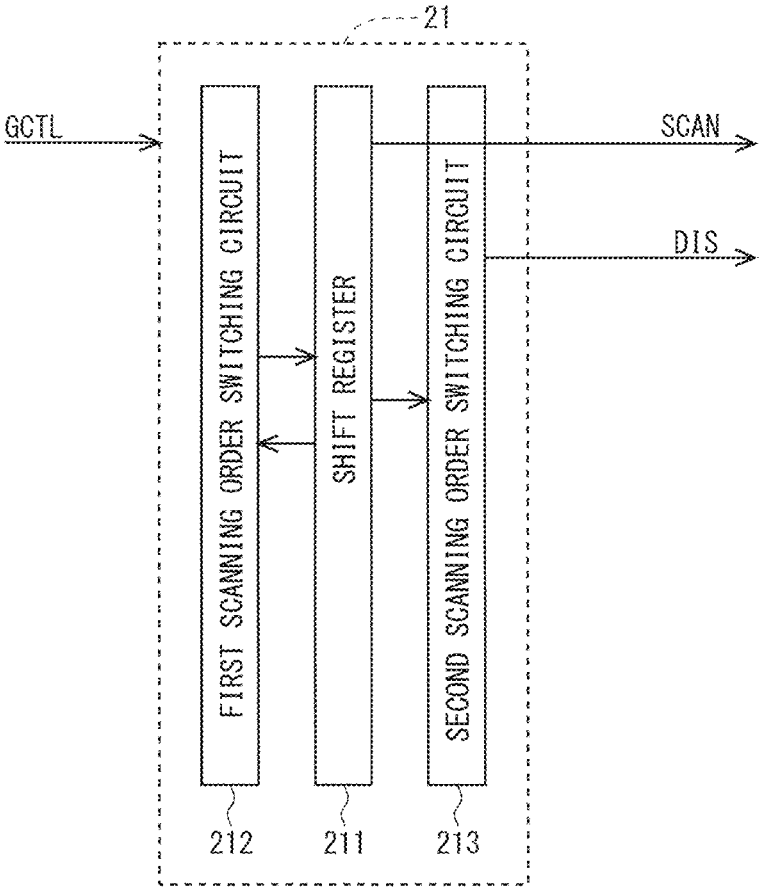
FIG. 1 is a block diagram showing a schematic configuration of a gate driver in one embodiment.

FIG. 1 is a block diagram showing a schematic configuration of the gate driver 21 of the present embodiment. As shown in FIG. 1, the gate driver 21 includes a shift register 211 for driving n write control lines SCAN(1) to SCAN(n) disposed in the display unit 10, according to a vertical scanning direction; a first scanning order switching circuit 212 for controlling operation of the shift register 211 according to the vertical scanning direction; and a second scanning order switching circuit 213 for driving n initialization control lines DIS(1) to DIS(n) disposed in the display unit 10, according to the vertical scanning direction.

Figure 7:
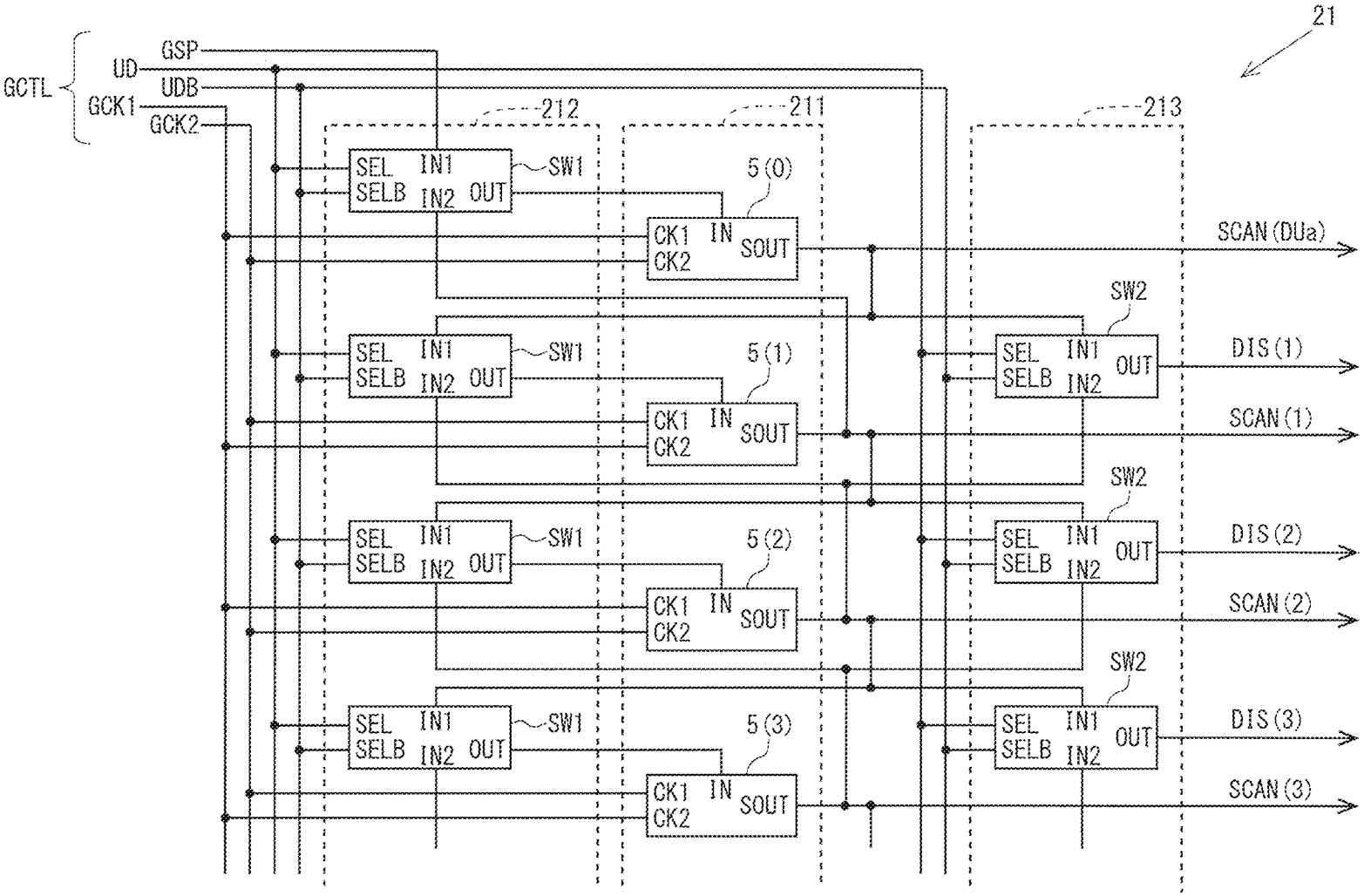
FIG. 7 is a block diagram showing a detailed configuration of the gate driver (a configuration of a portion of a shift register near its initial stage side) in the embodiment.
Figure 8:
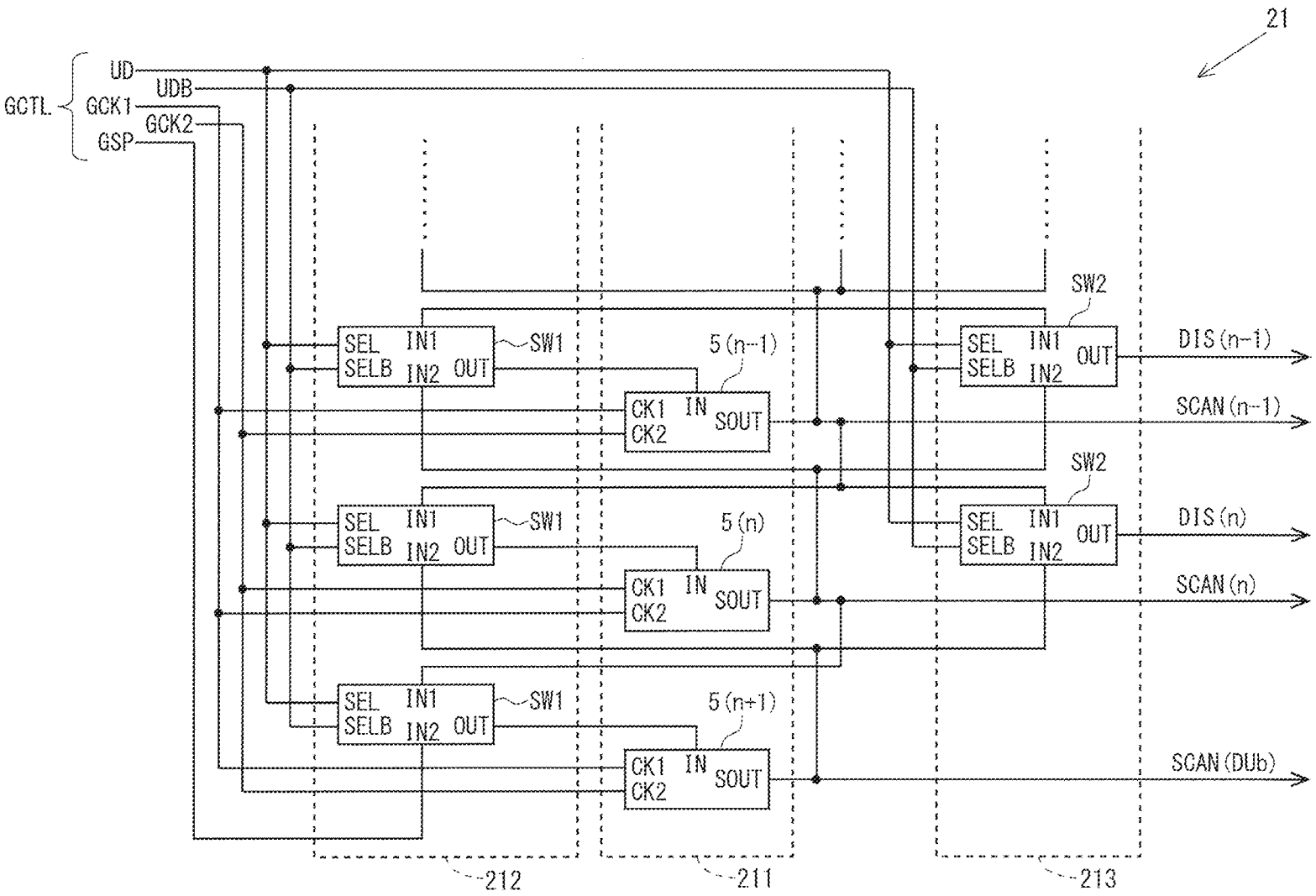
FIG. 8 is a block diagram showing a detailed configuration of the gate driver (a configuration of a portion of the shift register near its last stage side) in the embodiment.

FIGS. 7 and 8 are block diagrams showing a detailed configuration of the gate driver 21. FIG. 7 shows a configuration of a portion of the shift register 211 near its initial stage side, and FIG. 8 shows a configuration of a portion of the shift register 211 near its last stage side. The shift register 211 is constituted of (n+2) unit circuits 5(0) to 5(*n*+1). The unit circuits 5(1) to 5(*n*) are connected to the write control lines SCAN(1) to SCAN(n), respectively. In addition, the unit circuit 5(0) is connected to a dummy write control line SCAN(DUa), and the unit circuit 5(*n*+1) is connected to a dummy write control line SCAN(DUb). Note that in the following description, when an unspecified unit circuit is referred to, the unit circuit is given reference character 5. The first scanning order switching circuit 212 includes (n+2) switching circuits (hereinafter, referred to as "first switching circuits".) SW1 respectively corresponding to the (n+2) unit circuits 5(0) to 5(*n*+1). The second scanning order switching circuit 213 includes n switching circuits (hereinafter, referred to as "second switching circuits".) SW2 respectively connected to the n initialization control lines DIS(1) to DIS(n). In the present embodiment, the first switching circuits SW1 and the second switching circuits SW2 have the same configuration.

As shown in FIGS. 7 and 8, to the gate driver 21 there are provided, as control signals GCTL, a gate start pulse signal GSP, gate clock signals GCK1 and GCK2 which are two-phase clock signals, and scanning order instruction signals UD and UDB that indicate vertical scanning directions (scanning order of the n write control lines SCAN(1) to SCAN(n) and the n initialization control lines DIS(1) to DIS(n)). The gate start pulse signal GSP is provided to a first switching circuit SW1 corresponding to the unit circuit 5(0) and a first switching circuit SW1 corresponding to the unit circuit 5(*n*+1). The gate clock signals GCK1 and GCK2 are provided to the unit circuits 5(0) to 5(*n*+1). The scanning order instruction signals UD and UDB are provided to all of the first switching circuits SW1 and all of the second switching circuits SW2. Note that in the present embodiment, a normal order scanning instruction signal is implemented by the scanning order instruction signal UDB, and a reverse order scanning instruction signal is implemented by the scanning order instruction signal UD.

Each unit circuit 5 includes input terminals for receiving a set input signal IN, a clock signal CK1, and a clock signal CK2; and an output terminal for outputting an output signal SOUT. To each unit circuit 5 there is provided, as the set input signal IN, an output signal OUT from a corresponding first switching circuit SW1. In addition, when the unit circuit 5(0) is defined as the first stage, to unit circuits 5 in odd-numbered stages there are provided the gate clock signal GCK1 as the clock signal CK1 and the gate clock signal GCK2 as the clock signal CK2, and to unit circuits 5 in even-numbered stages there are provided the gate clock signal GCK2 as the clock signal CK1 and the gate clock signal GCK1 as the clock signal CK2. Output signals SOUT from the unit circuits 5(1) to 5(*n*) are applied, as first scanning signals, to corresponding write control lines SCAN.

Each first switching circuit SW1 includes input terminals for receiving a first selection signal SEL, a second selection signal SELB, a first input signal IN1, and a second input signal IN2; and an output terminal for outputting an output signal OUT. To each first switching circuit SW1 there are inputted the scanning order instruction signal UD as the first selection signal SEL and the scanning order instruction signal UDB as the second selection signal SELB. With K being an integer between 0 and (n+1), inclusive, to a first switching circuit SW1 corresponding to a unit circuit 5(K) there are provided an output signal SOUT from a unit circuit 5(K−1) as the first input signal IN1 and an output signal SOUT from a unit circuit 5(K+1) as the second input signal IN2. Note, however, that the gate start pulse signal GSP is provided, as the first input signal IN1, to a first switching circuit SW1 corresponding to the unit circuit 5(0), and the gate start pulse signal GSP is provided, as the second input signal IN2, to a first switching circuit SW1 corresponding to the unit circuit 5(*n*+1). An output signal OUT from each first switching circuit SW1 is provided, as the set input signal IN, to a corresponding unit circuit 5.

Each second switching circuit SW2 includes input terminals for receiving a first selection signal SEL, a second selection signal SELB, a first input signal IN1, and a second input signal IN2; and an output terminal for outputting an output signal OUT. To each second switching circuit SW2 there are inputted the scanning order instruction signal UD as the first selection signal SEL and the scanning order instruction signal UDB as the second selection signal SELB. With P being a natural number between 1 and n, inclusive, to a second switching circuit SW2 connected to an initialization control line DIS(P) there are provided an output signal SOUT from a unit circuit 5(P−1) as the first input signal IN1 and an output signal SOUT from a unit circuit 5(P+1) as the second input signal IN2. The output signal OUT from each second switching circuit SW2 is applied, as a second scanning signal, to a corresponding initialization control line DIS.

Note that for the shift register 211 of the present embodiment, one unit circuit 5 is provided both at a previous stage side and at a subsequent stage side of the n unit circuits 5(1) to 5(*n*) respectively connected to the n write control lines SCAN(1) to SCAN(n). However, the configuration is not limited thereto, and two or more unit circuits 5 may be provided both at the previous stage side and at the subsequent stage side of the n unit circuits 5(1) to 5(*n*). That is, the shift register 211 may be constituted of a plurality of unit circuits 5 including n unit circuits 5(1) to 5(*n*) respectively connected to n write control lines SCAN(1) to SCAN(n); one or more unit circuits 5 provided at the previous stage side of the n unit circuits 5(1) to 5(*n*); and one or more unit circuits 5 provided at the subsequent stage side of the n unit circuits 5(1) to 5(*n*).

<3.2 Configuration and Operation of a Unit Circuit>

Figure 9:
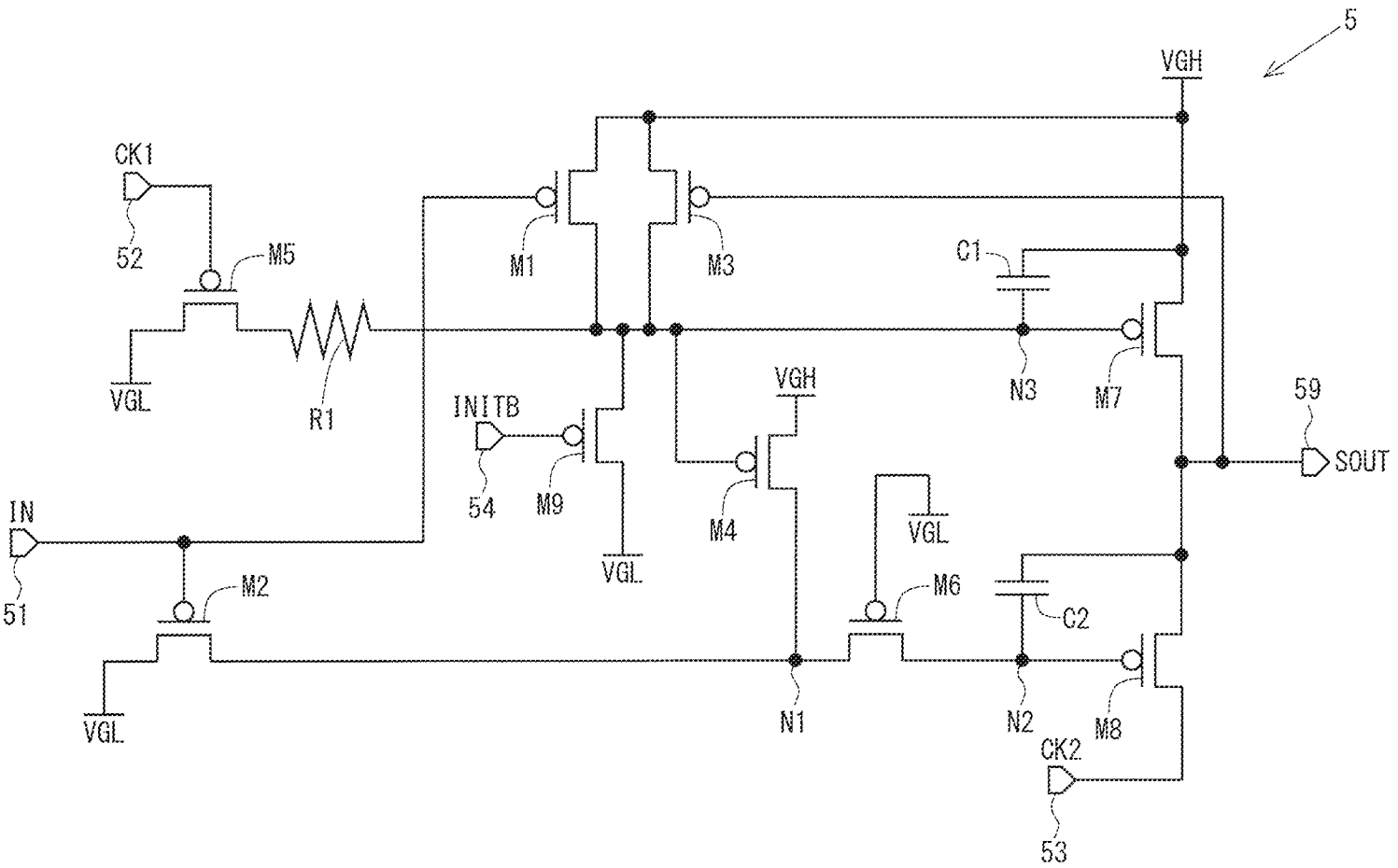
FIG. 9 is a circuit diagram showing an exemplary configuration of a unit circuit in the embodiment.

FIG. 9 is a circuit diagram showing an exemplary configuration of a unit circuit 5 of the present embodiment. As shown in FIG. 9, the unit circuit 5 includes nine transistors M1 to M9, two capacitors C1 and C2, and one resistor R1.

The transistors M1 to M9 are P-channel type transistors. The unit circuit 5 also has four input terminals 51 to 54 and one output terminal 59 in addition to an input terminal connected to a first constant potential line that supplies a gate high potential VGH and an input terminal connected to a second constant potential line that supplies a gate low potential VGL. In FIG. 9, an input terminal for receiving a set input signal IN is given reference character 51, an input terminal for receiving a clock signal CK1 is given reference character 52, an input terminal for receiving a clock signal CK2 is given reference character 53, an input terminal for receiving an initialization signal INITB is given reference character 54, and an output terminal for outputting an output signal SOUT is given reference character 59. Note that in FIGS. 7 and 8, regarding the unit circuits 5, depiction of the input terminal connected to the first constant potential line, the input terminal connected to the second constant potential line, and the input terminal 54 is omitted.

A second conductive terminal of the transistor M2, a first conductive terminal of the transistor M4, and a first conductive terminal of the transistor M6 are connected to each other. Note that a node where they are connected to each other is referred to as "first internal node". The first internal node is given reference character N1. A second conductive terminal of the transistor M6, a control terminal of the transistor M8, and a first electrode of the capacitor C2 are connected to each other. Note that a node where they are connected to each other is referred to as "second internal node". The second internal node is given reference character N2. A first conductive terminal of the transistor M1, a first conductive terminal of the transistor M3, a control terminal of the transistor M4, a control terminal of the transistor M7, a second conductive terminal of the transistor M9, a first electrode of the capacitor C1, and one end of the resistor R1 are connected to each other. Note that a node where they are connected to each other is referred to as "third internal node". The third internal node is given reference character N3.

The transistor M1 is connected at its control terminal to the input terminal 51, connected at its first conductive terminal to the third internal node N3, and connected at its second conductive terminal to the first constant potential line. The transistor M2 is connected at its control terminal to the input terminal 51, connected at its first conductive terminal to the second constant potential line, and connected at its second conductive terminal to the first internal node N1. The transistor M3 is connected at its control terminal to the output terminal 59, connected at its first conductive terminal to the third internal node N3, and connected at its second conductive terminal to the first constant potential line. The transistor M4 is connected at its control terminal to the third internal node N3, connected at its first conductive terminal to the first internal node N1, and connected at its second conductive terminal to the first constant potential line. The transistor M5 is connected at its control terminal to the input terminal 52, connected at its first conductive terminal to the second constant potential line, and connected at its second conductive terminal to the other end of the resistor R1. The transistor M6 is connected at its control terminal to the second constant potential line, connected at its first conductive terminal to the first internal node N1, and connected at its second conductive terminal to the second internal node N2. The transistor M7 is connected at its control terminal to the third internal node N3, connected at its first conductive terminal to the output terminal 59, and connected at its second conductive terminal to the first constant potential line. The transistor M8 is connected at its control terminal to the second internal node N2, connected at its first conductive terminal to the input terminal 53, and connected at its second conductive terminal to the output terminal 59. The transistor M9 is connected at its control terminal to the input terminal 54, connected at its first conductive terminal to the second constant potential line, and connected at its second conductive terminal to the third internal node N3. The capacitor C1 is connected at its first electrode to the third internal node N3 and connected at its second electrode to the second conductive terminal of the transistor M7. The capacitor C2 is connected at its first electrode to the second internal node N2 and connected at its second electrode to the second conductive terminal of the transistor M8. The resistor R1 is connected at its one end to the third internal node N3 and connected at its other end to the second conductive terminal of the transistor M5.

The initialization signal INITB provided to the input terminal 54 is maintained at high level at normal operation. Thus, the transistor M9 is maintained in off state throughout a period during which normal operation is performed.

Now, the transistor M6 is taken look at. A gate low potential VGL is provided to the control terminal of the transistor M6. The gate low potential VGL is a potential having a level at which the transistor M6 is maintained in on state, except when the potential at the first internal node N1 or the second internal node N2 is lower than a normal low level. That is, the transistor M6 is maintained in on state except when the potential at the first internal node N1 or the second internal node N2 is lower than the normal low level. When the potential at the second internal node N2 reaches less than or equal to a predetermined value, the transistor M6 goes into off state, electrically disconnecting the first internal node N1 and the second internal node N2. By this, the transistor M6 assists in reduction of potential at the second internal node N2 when the second internal node N2 goes into boost state.

Note that the configuration of the unit circuit 5 shown in FIG. 9 is an example, and thus, unit circuits of various configurations can be adopted.

Figure 10:
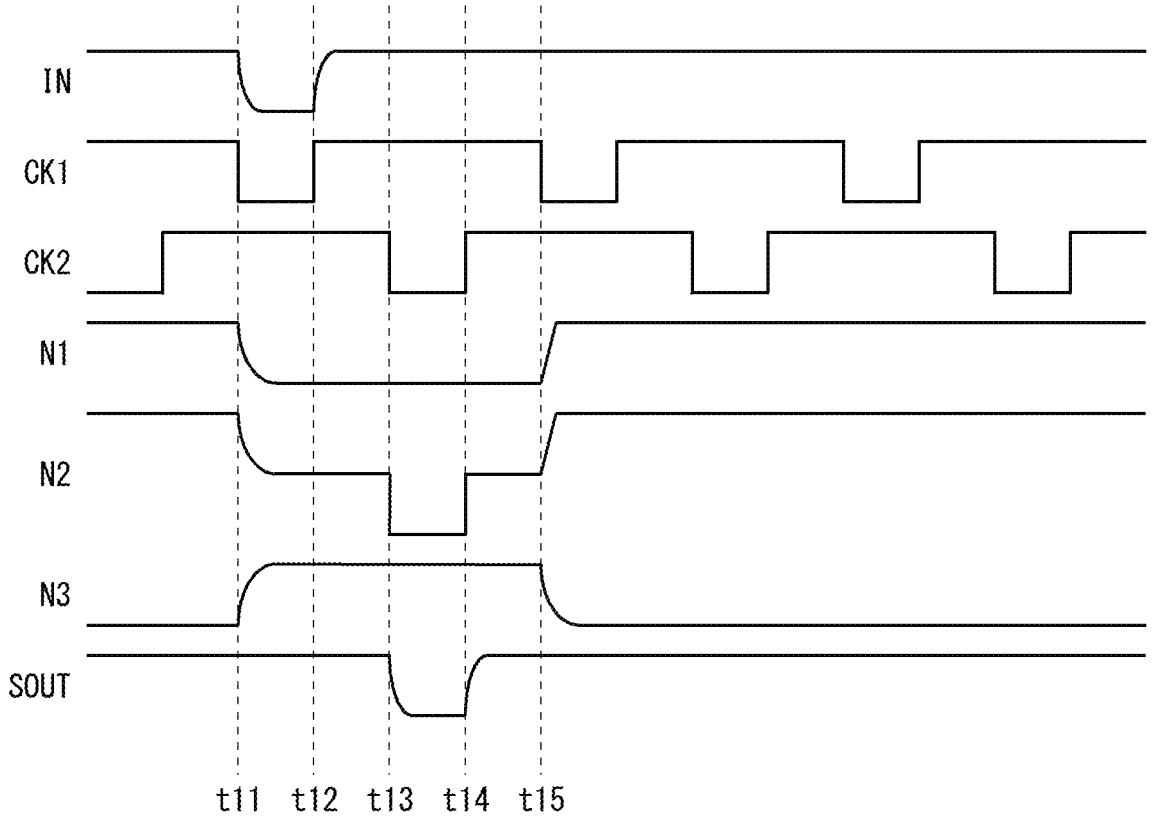
FIG. 10 is a timing chart for describing operation of the unit circuit in the embodiment.

Next, with reference to FIG. 10, operation of the unit circuit 5 will be described. Note that it is assumed that a period from time t13 to time t14 is a period during which a pulse of the output signal SOUT is to be outputted from the unit circuit 5.

At a point in time immediately before time t11, the set input signal IN is at high level, the clock signal CK1 is at high level, the clock signal CK2 is at high level, the potential at the first internal node N1 is at high level, the potential at the second internal node N2 is at high level, the potential at the third internal node N3 is at low level, and the output signal SOUT is at high level.

At time t11, the set input signal IN changes from high level to low level. By this, the transistor M2 goes into on state and the potentials at the first internal node N1 and the second internal node N2 decrease. As a result, the transistor M8 goes into on state. However, during a period from time t11 to time t12, the clock signal CK2 is maintained at high level and thus the potential at the output terminal 59 (the potential of the output signal SOUT) is maintained at high level. In addition, at time t11, the transistor M1 goes into on state and thus the potential at the third internal node N3 increases.

During a period from time t12 to time t13, as with the period from time t11 to time t12, the clock signal CK2 is maintained at high level. Thus, during the period from time t12 to time t13, the potential at the output terminal 59 (the potential of the output signal SOUT) is maintained at high level.

At time t13, the clock signal CK2 changes from high level to low level. At this time, the transistor M8 is in on state and thus with a reduction in potential at the input terminal 53, the potential at the output terminal 59 (the potential of the output signal SOUT) decreases. Here, since the capacitor C2 is provided between the second internal node N2 and the output terminal 59, with the reduction in potential at the output terminal 59, the potential at the second internal node N2 also decreases. As a result, a large negative voltage is applied to the control terminal of the transistor M8, sufficiently reducing the potential at the output terminal 59 (the potential of the output signal SOUT). Note that during a period from time t13 to time t14, the transistor M6 is in off state, and the potential at the first internal node N1 is maintained at a potential obtained before time t13.

At time t14, the clock signal CK2 changes from low level to high level. By this, with an increase in potential at the input terminal 53, the potential at the output terminal 59 (the potential of the output signal SOUT) increases. When the potential at the output terminal 59 increases, the potential at the second internal node N2 also increases through the capacitor C2. By this, the transistor M6 goes into on state.

At time t15, the clock signal CK1 changes from high level to low level. By this, the transistor M5 goes into on state, reducing the potential at the third internal node N3. By the reduction in potential at the third internal node N3, the transistor M4 goes into on state. As a result, the potential at the first internal node N1 increases. At this time, since the transistor M6 is in on state, the potential at the second internal node N2 also increases.

During a period after time t15, as with the period before time t11, the set input signal IN is maintained at high level, the potential at the first internal node N1 is maintained at high level, the potential at the second internal node N2 is maintained at high level, the potential at the third internal node N3 is maintained at low level, and the output signal SOUT is maintained at high level.

<3.3 Configuration and Operation of a Switching Circuit>

Figure 11:
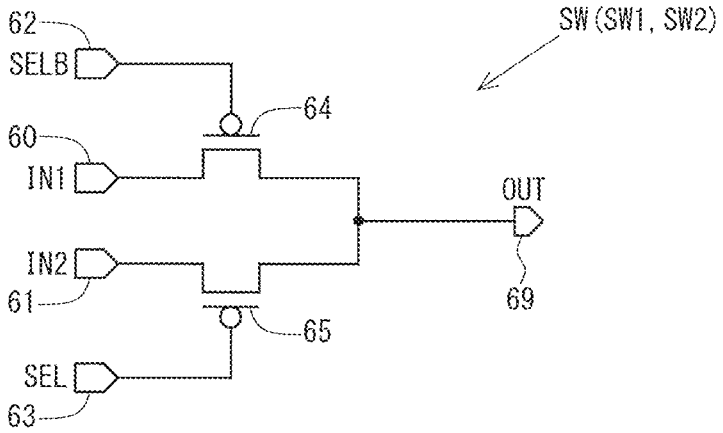
FIG. 11 is a circuit diagram showing a configuration of a switching circuit in the embodiment.

FIG. 11 is a circuit diagram showing a configuration of a switching circuit SW (a first switching circuit SW1 and a second switching circuit SW2) of the present embodiment. The switching circuit SW includes two transistors 64 and 65. The transistors 64 and 65 are P-channel type transistors. The switching circuit SW also has four input terminals 60 to 63 and one output terminal 69. In FIG. 11, an input terminal to which a first input signal IN1 is provided is given reference character 60, an input terminal to which a second input signal IN2 is provided is given reference character 61, an input terminal to which a second selection signal SELB is provided is given reference character 62, and an input terminal to which a first selection signal SEL is provided is given reference character 63.

The transistor 64 is connected at its control terminal to the input terminal 62, connected at its first conductive terminal to the input terminal 60, and connected at its second conductive terminal to the output terminal 69. The transistor 65 is connected at its control terminal to the input terminal 63, connected at its first conductive terminal to the input terminal 61, and connected at its second conductive terminal to the output terminal 69.

In a configuration such as that described above, when normal order scanning is performed, the first selection signal SEL is maintained at high level and the second selection signal SELB is maintained at low level. At this time, the transistor 65 is maintained in off state and the transistor 64 is maintained in on state. By this, the first input signal IN1 provided to the input terminal 60 is outputted, as an output signal OUT, from the output terminal 69. In addition, when reverse order scanning is performed, the first selection signal SEL is maintained at low level and the second selection signal SELB is maintained at high level. At this time, the transistor 65 is maintained in on state and the transistor 64 is maintained in off state. By this, the second input signal IN2 provided to the input terminal 61 is outputted, as the output signal OUT, from the output terminal 69.

Note that in the present embodiment, a first transistor is implemented by the transistor 64, a second transistor is implemented by the transistor 65, a first input terminal is implemented by the input terminal 60, a second input terminal is implemented by the input terminal 61, a third input terminal is implemented by the input terminal 62, and a fourth input terminal is implemented by the input terminal 63.

<3.4 Overall Operation>

Considering the configuration of the gate driver 21 such as that described above, overall operation of the gate driver 21 performed when normal order scanning is performed and when reverse order scanning is performed will be described. Note that in the present embodiment, when a first scanning signal applied to a write control line SCAN is at low level, the write control line SCAN is in active state, and when a first scanning signal applied to a write control line SCAN is at high level, the write control line SCAN is in inactive state. Likewise, when a second scanning signal applied to an initialization control line DIS is at low level, the initialization control line DIS is in active state, and when a second scanning signal applied to an initialization control line DIS is at high level, the initialization control line DIS is in inactive state.

<3.4.1 Operation Performed when Normal Order Scanning is Performed>

Figure 12:
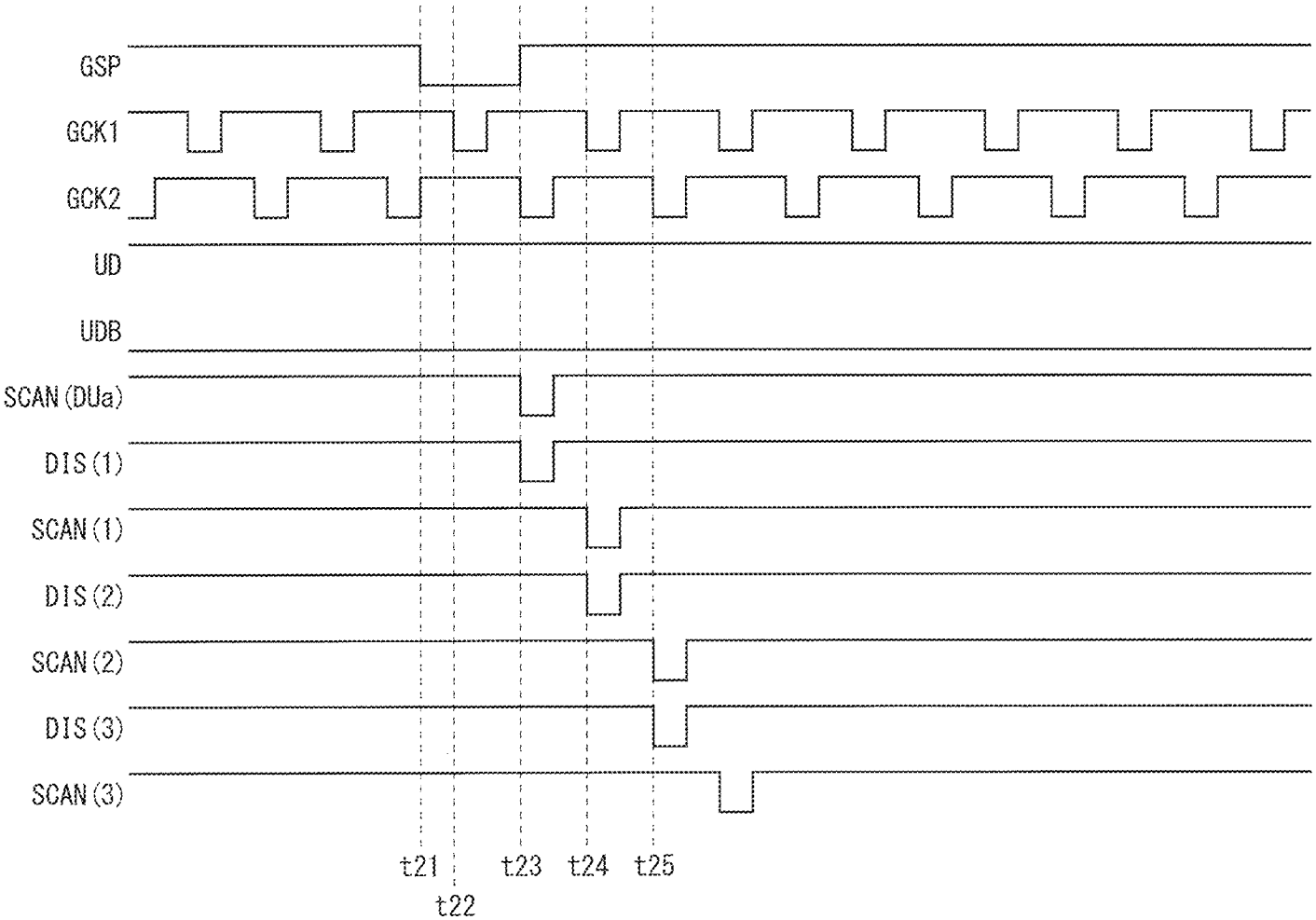
FIG. 12 is a timing chart for describing operation of the gate driver performed when normal order scanning is performed in the embodiment.
Figure 13:
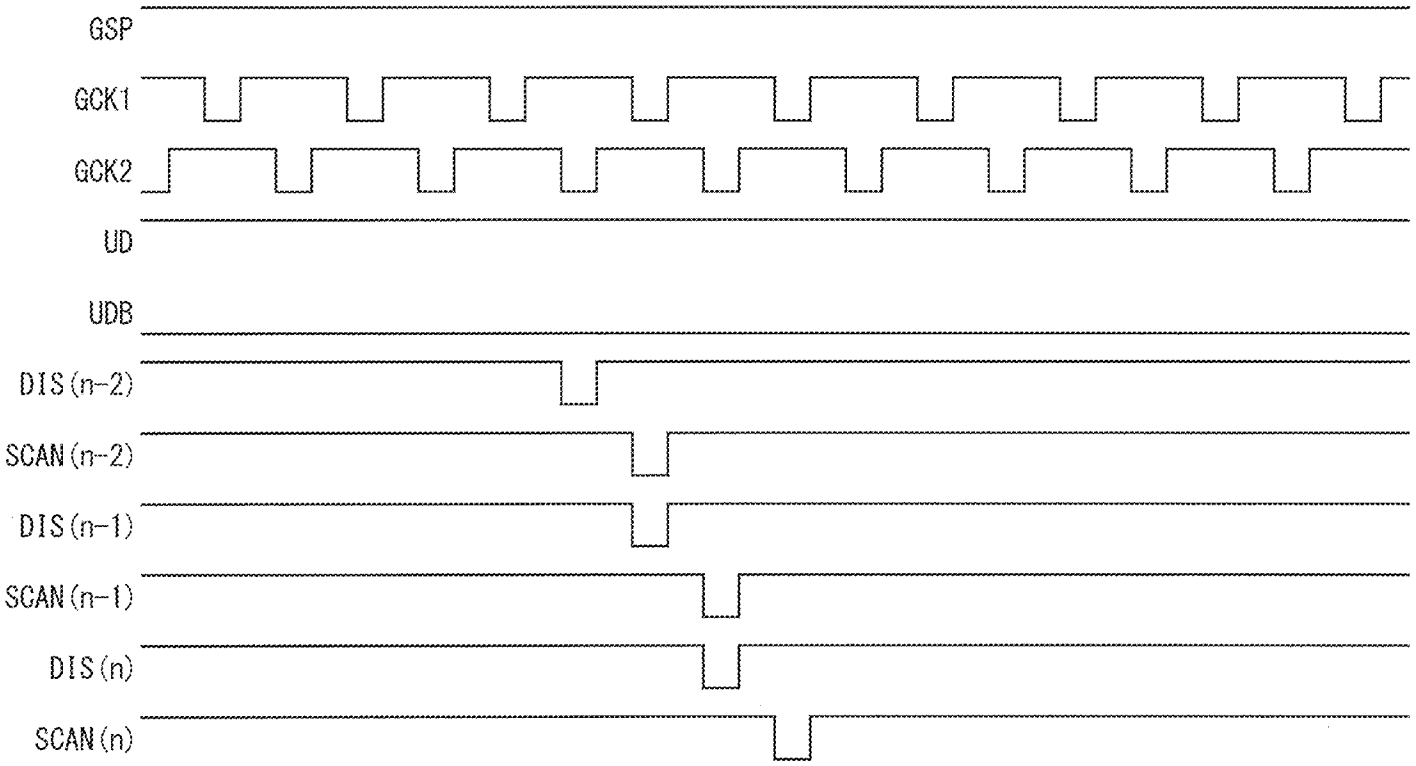
FIG. 13 is a timing chart for describing operation of the gate driver performed when normal order scanning is performed in the embodiment.

FIGS. 12 and 13 are timing charts for describing operation of the gate driver 21 performed when normal order scanning is performed. As shown in FIGS. 12 and 13, when normal order scanning is performed, the scanning order instruction signal UD is maintained at high level (off level) and the scanning order instruction signal UDB is maintained at low level (on level).

During a period earlier than time t21, all output signals SOUT (not shown in FIGS. 12 and 13) outputted from the unit circuits 5(0) to 5($n$+1) are at high level, and all write control lines SCAN(1) to SCAN(n) and all initialization control lines DIS(1) to DIS(n) are inactive.

At time t21, the gate start pulse signal GSP changes from high level to low level. As described above, the gate start pulse signal GSP is provided, as a first input signal IN1, to a first switching circuit SW1 corresponding to the unit circuit 5(0), and provided, as a second input signal IN2, to a first switching circuit SW1 corresponding to the unit circuit 5($n$+1). At this time, in each first switching circuit SW1 (see FIG. 11), the transistor 65 is maintained in off state and the transistor 64 is maintained in on state. As a result, an output signal OUT from the first switching circuit SW1 corresponding to the unit circuit 5(0) changes from high level to low level. By this, a set input signal IN provided to the input terminal 51 of the unit circuit 5(0) changes from high level to low level.

At time t22, the gate clock signal GCK1 changes from high level to low level. The gate clock signal GCK1 is provided, as a clock signal CK1, to the input terminal 52 of the unit circuit 5(0). Thus, at time t22, the transistor M5 in the unit circuit 5(0) goes into on state. At this time, the set input signal IN provided to the input terminal 51 of the unit circuit 5(0) is at low level, and thus, the potential at the first internal node N1 decreases in the unit circuit 5(0). As a result, the transistor M8 in the unit circuit 5(0) goes into on state.

At time t23, the gate clock signal GCK2 changes from high level to low level. The gate clock signal GCK2 is provided, as a clock signal CK2, to the input terminal 53 of the unit circuit 5(0). The transistor M8 in the unit circuit 5(0) goes into on state at time t22 as described above, and thus, by the gate clock signal GCK2 changing from high level to low level, the output signal SOUT from the unit circuit 5(0) is brought to low level. That is, the dummy write control line SCAN(DUa) becomes active. In addition, the output signal SOUT from the unit circuit 5(0) is provided, as a first input signal IN1, to a second switching circuit SW2 connected to the initialization control line DIS(1). At this time, in each second switching circuit SW2 (see FIG. 11), the transistor 65 is maintained in off state and the transistor 64 is maintained in on state. From the above, an output signal OUT from the second switching circuit SW2 connected to the initialization control line DIS(1) changes from high level to low level. That is, the initialization control line DIS(1) becomes active.

Meanwhile, the output signal SOUT from the unit circuit 5(0) is provided, as a first input signal IN1, to a first switching circuit SW1 corresponding to the unit circuit 5(1). In addition, in each first switching circuit SW1, the transistor 65 is maintained in off state and the transistor 64 is maintained in on state. From the above, at time t23, an output signal OUT from the first switching circuit SW1 corresponding to the unit circuit 5(1) changes from high level to low level. By this, a set input signal IN provided to the input terminal 51 of the unit circuit 5(1) changes from high level to low level. Since the gate clock signal GCK2 is provided, as a clock signal CK1, to the input terminal 52 of the unit circuit 5(1), at time t23, the transistor M5 in the unit circuit 5(1) goes into on state. At this time, the set input signal IN provided to the input terminal 51 of the unit circuit 5(1) is at low level as described above, and thus, the potential at the first internal node N1 decreases in the unit circuit 5(1). As a result, the transistor M8 in the unit circuit 5(1) goes into on state.

At time t24, the gate clock signal GCK1 changes from high level to low level. The gate clock signal GCK1 is provided, as a clock signal CK2, to the input terminal 53 of the unit circuit 5(1). The transistor M8 in the unit circuit 5(1) goes into on state at time t23 as described above, and thus, by the gate clock signal GCK1 changing from high level to low level, the output signal SOUT from the unit circuit 5(1) is brought to low level. That is, the write control line SCAN(1) becomes active. In addition, the output signal SOUT from the unit circuit 5(1) is provided, as a first input signal IN1, to a second switching circuit SW2 connected to the initialization control line DIS(2). At this time, in each second switching circuit SW2, the transistor 65 is maintained in off state and the transistor 64 is maintained in on state. From the above, an output signal OUT from the second switching circuit SW2 connected to the initialization control line DIS(2) changes from high level to low level. That is, the initialization control line DIS(2) becomes active.

Likewise, at time t25, the write control line SCAN(2) and the initialization control line DIS(3) become active.

In the above-described manner, the first initialization control line DIS(1) to the nth initialization control line DIS(n) sequentially become active, and the first write control line SCAN(1) to the nth write control line SCAN(n) sequentially become active. At that time, with k being a natural number between 1 and (n−1), inclusive, a kth write control line SCAN(k) and a (k+1)th initialization control line DIS(k+1) become active at the same timing.

<3.4.2 Operation Performed when Reverse Order Scanning is Performed>

Figure 14:
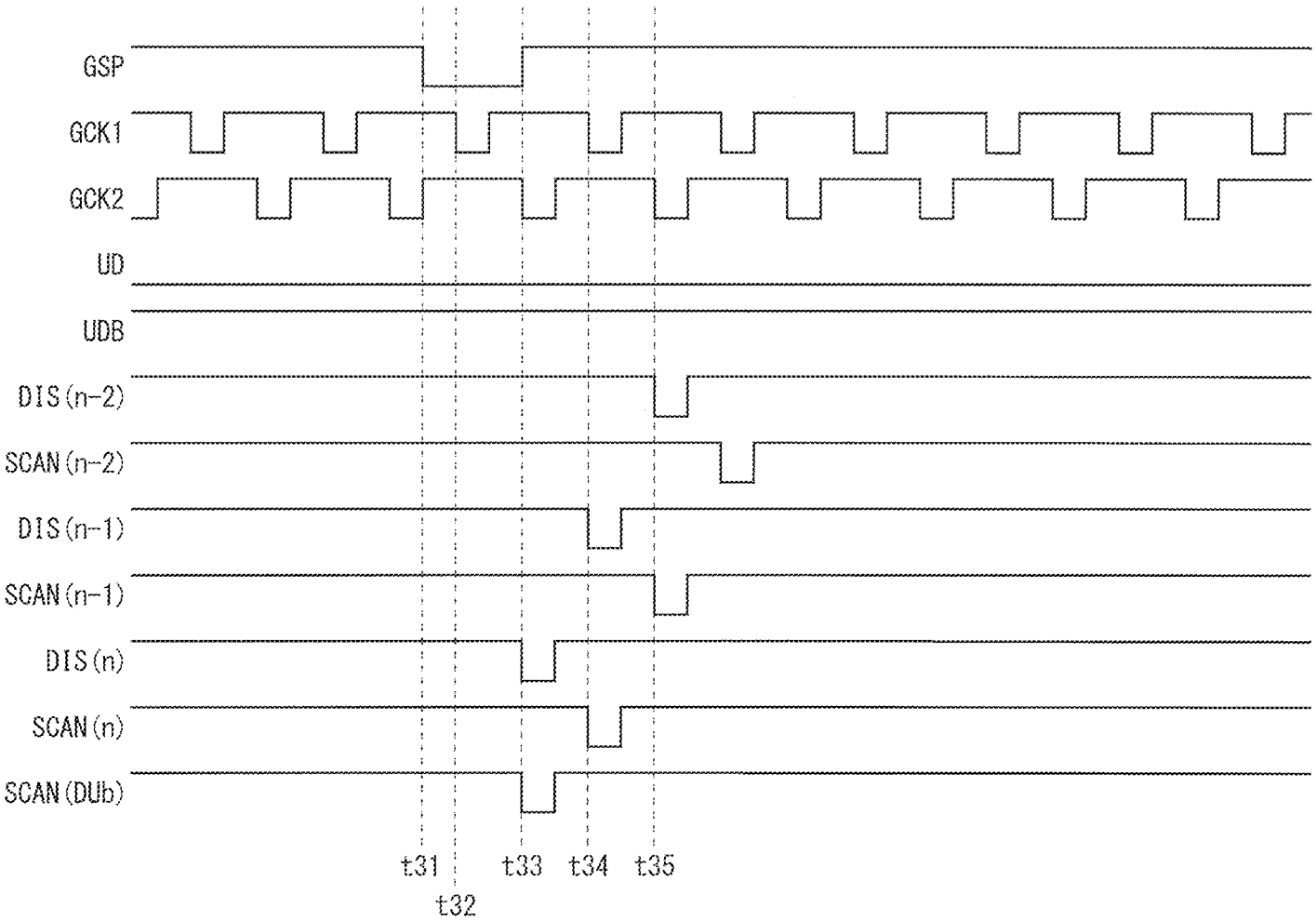
FIG. 14 is a timing chart for describing operation of the gate driver performed when reverse order scanning is performed in the embodiment.
Figure 15:
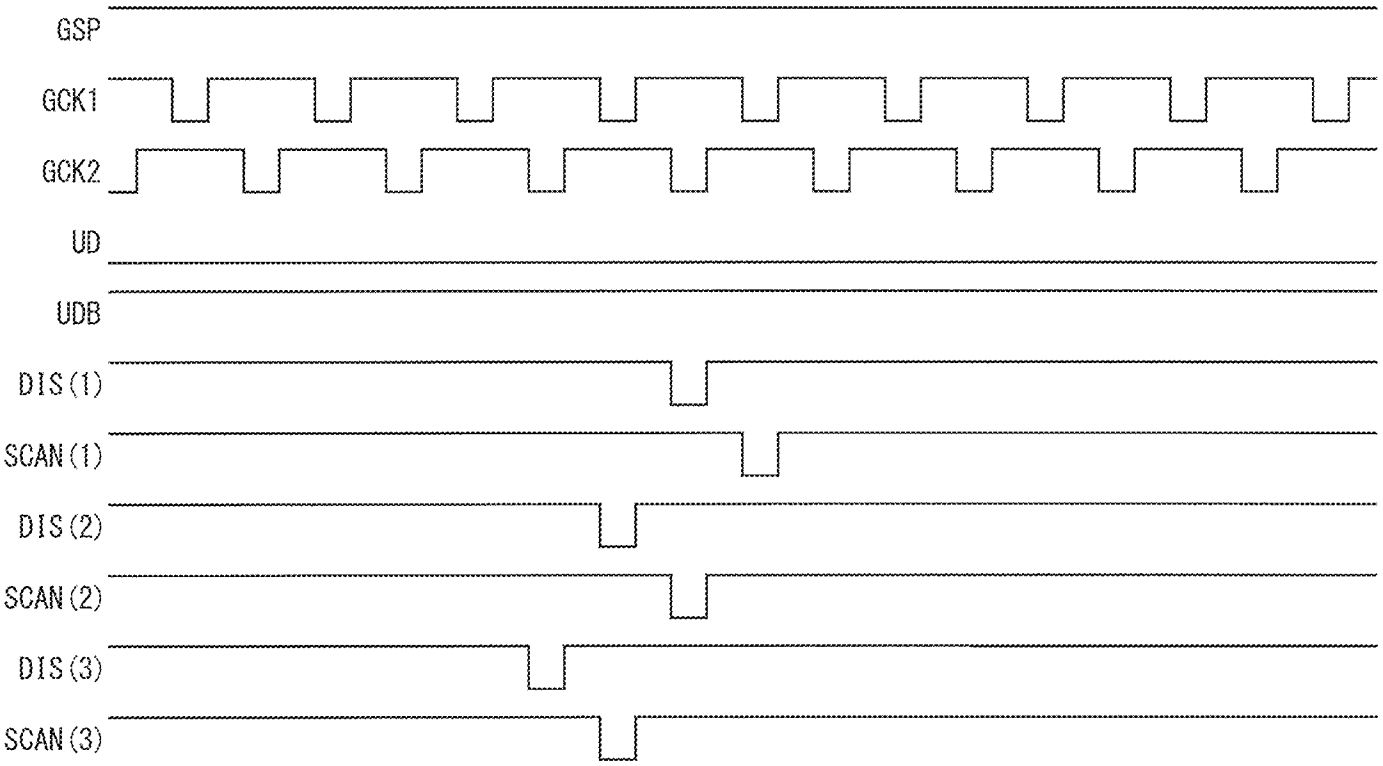
FIG. 15 is a timing chart for describing operation of the gate driver performed when reverse order scanning is performed in the embodiment.

FIGS. 14 and 15 are timing charts for describing operation of the gate driver 21 performed when reverse order scanning is performed. As shown in FIGS. 14 and 15, when reverse order scanning is performed, the scanning order instruction signal UD is maintained at low level (on level) and the scanning order instruction signal UDB is maintained at high level (off level).

During a period earlier than time t31, all output signals SOUT (not shown in FIGS. 14 and 15) outputted from the unit circuits 5(0) to 5(*n*+1) are at high level, and all write control lines SCAN(1) to SCAN(n) and all initialization control lines DIS(1) to DIS(n) are inactive.

At time t31, the gate start pulse signal GSP changes from high level to low level. As described above, the gate start pulse signal GSP is provided, as a first input signal IN1, to a first switching circuit SW1 corresponding to the unit circuit 5(0), and provided, as a second input signal IN2, to a first switching circuit SW1 corresponding to the unit circuit 5(*n*+1). At this time, in each first switching circuit SW1 (see FIG. 11), the transistor 65 is maintained in on state and the transistor 64 is maintained in off state. As a result, an output signal OUT from the first switching circuit SW1 corresponding to the unit circuit 5(*n*+1) changes from high level to low level. By this, a set input signal IN provided to the input terminal 51 of the unit circuit 5(*n*+1) changes from high level to low level.

At time t32, the gate clock signal GCK1 changes from high level to low level. The gate clock signal GCK1 is provided, as a clock signal CK1, to the input terminal 52 of the unit circuit 5(*n*+1). Thus, at time t32, the transistor M5 in the unit circuit 5(*n*+1) goes into on state. At this time, the set input signal IN provided to the input terminal 51 of the unit circuit 5(*n*+1) is at low level, and thus, the potential at the first internal node N1 decreases in the unit circuit 5(*n*+1). As a result, the transistor M8 in the unit circuit 5(*n*+1) goes into on state.

At time t33, the gate clock signal GCK2 changes from high level to low level. The gate clock signal GCK2 is provided, as a clock signal CK2, to the input terminal 53 of the unit circuit 5(*n*+1). The transistor M8 in the unit circuit 5(*n*+1) goes into on state at time t32 as described above, and thus, by the gate clock signal GCK2 changing from high level to low level, the output signal SOUT from the unit circuit 5(*n*+1) is brought to low level. That is, the dummy write control line SCAN(DUb) becomes active. In addition, the output signal SOUT from the unit circuit 5(*n*+1) is provided, as a second input signal IN2, to a second switching circuit SW2 connected to the initialization control line DIS(n). At this time, in each second switching circuit SW2 (see FIG. 11), the transistor 65 is maintained in on state and the transistor 64 is maintained in off state. From the above, an output signal OUT from the second switching circuit SW2 connected to the initialization control line DIS(n) changes from high level to low level. That is, the initialization control line DIS(n) becomes active.

Meanwhile, the output signal SOUT from the unit circuit 5(*n*+1) is provided, as a second input signal IN2, to a first switching circuit SW1 corresponding to the unit circuit 5(*n*). In addition, in each first switching circuit SW1, the transistor 65 is maintained in on state and the transistor 64 is maintained in off state. From the above, at time t33, an output signal OUT from the first switching circuit SW1 corresponding to the unit circuit 5(*n*) changes from high level to low level. By this, a set input signal IN provided to the input terminal 51 of the unit circuit 5(*n*) changes from high level to low level. Since the gate clock signal GCK2 is provided, as a clock signal CK1, to the input terminal 52 of the unit circuit 5(*n*), at time t33, the transistor M5 in the unit circuit 5(*n*) goes into on state. At this time, the set input signal IN provided to the input terminal 51 of the unit circuit 5(*n*) is at low level as described above, and thus, the potential at the first internal node N1 decreases in the unit circuit 5(*n*). As a result, the transistor M8 in the unit circuit 5(*n*) goes into on state.

At time t34, the gate clock signal GCK1 changes from high level to low level. The gate clock signal GCK1 is provided, as a clock signal CK2, to the input terminal 53 of the unit circuit 5(*n*). The transistor M8 in the unit circuit 5(*n*) goes into on state at time t33 as described above, and thus, by the gate clock signal GCK1 changing from high level to low level, the output signal SOUT from the unit circuit 5(*n*) is brought to low level. That is, the write control line SCAN(n) becomes active. In addition, the output signal SOUT from the unit circuit 5(*n*) is provided, as a second input signal IN2, to a second switching circuit SW2 connected to the initialization control line DIS(n−1). At this time, in each second switching circuit SW2, the transistor 65 is maintained in on state and the transistor 64 is maintained in off state. From the above, an output signal OUT from the second switching circuit SW2 connected to the initialization control line DIS(n−1) changes from high level to low level. That is, the initialization control line DIS(n−1) becomes active.

Likewise, at time t35, the write control line SCAN(n−1) and the initialization control line DIS(n−2) become active.

In the above-described manner, the nth initialization control line DIS(n) to the first initialization control line DIS(1) sequentially become active, and the nth write control line SCAN(n) to the first write control line SCAN(1) sequentially become active. At that time, with k being a natural number between 2 and n, inclusive, a kth write control line SCAN(k) and a (k−1)th initialization control line DIS(k−1) become active at the same timing.

<4. Effects>

According to the present embodiment, the gate driver 21 is constituted of the shift register 211 including n unit circuits 5(1) to 5(*n*) respectively connected to n write control lines SCAN(1) to SCAN(n); and the first and second scanning order switching circuits 212 and 213 for enabling switching between vertical scanning directions. The first scanning order switching circuit 212 controls operation of the shift register 211 according to a vertical scanning direction. Thus, a bidirectional shift register is implemented by the shift register 211 and the first scanning order switching circuit 212. The second scanning order switching circuit 213 includes n switching circuits (second switching circuits) SW2 and drives n initialization control lines DIS(1) to DIS(n) according to the vertical scanning direction. Specifically, with P being a natural number, a second switching circuit SW2 connected to a Pth initialization control line DIS(P) applies, based on scanning order instruction signals UD and UDB, an output signal SOUT from a unit circuit 5(P−1) connected to a (P−1)th write control line SCAN (P−1) or an output signal SOUT from a unit circuit 5(P+1) connected to a (P+1)th write control line SCAN(P+1), as a second scanning signal, to the Pth initialization control line DIS(P). By this, when normal order scanning is performed, a Pth write control line SCAN(P) and a (P+1)th initialization control line DIS(P+1) become active at the same timing, and when reverse order scanning is performed, the Pth write control line SCAN(P) and a (P−1)th initialization control line DIS(P−1) become active at the same timing. As a result, in each pixel circuit 100, regardless of the vertical scanning direction, an initialization control line DIS to which the each pixel circuit 100 is connected becomes active, and then a write control line SCAN to which the each pixel circuit 100 is connected becomes active. That is, switching between vertical scanning directions is performed normally. Meanwhile, the second scanning order switching circuit 213 is, as described above, constituted of n switching circuits (second switching circuits) SW2. Thus, by a configuration in which n switching circuits are added to the bidirectional shift register of one system, an organic EL display device including two types of horizontal scanning lines (write control lines SCAN and initialization control lines DIS) can perform switching between vertical scanning directions. A circuit area required for the configuration in which n switching circuits are added to the bidirectional shift register of one system is smaller than a circuit area required to form bidirectional shift registers of two systems, and thus, according to the present embodiment, narrowing of a picture-frame of the organic EL display device that can perform switching between vertical scanning directions (scanning order of the plurality of horizontal scanning lines) is implemented.

<5. Variants>

<5.1 First Variant>

In the above-described embodiment, the switching circuits SW (the first switching circuits SW1 and the second switching circuits SW2) have a configuration such as that shown in FIG. 11. However, the present disclosure is not limited thereto. Hence, another exemplary configuration of a switching circuit SW will be described below.

Figure 16:
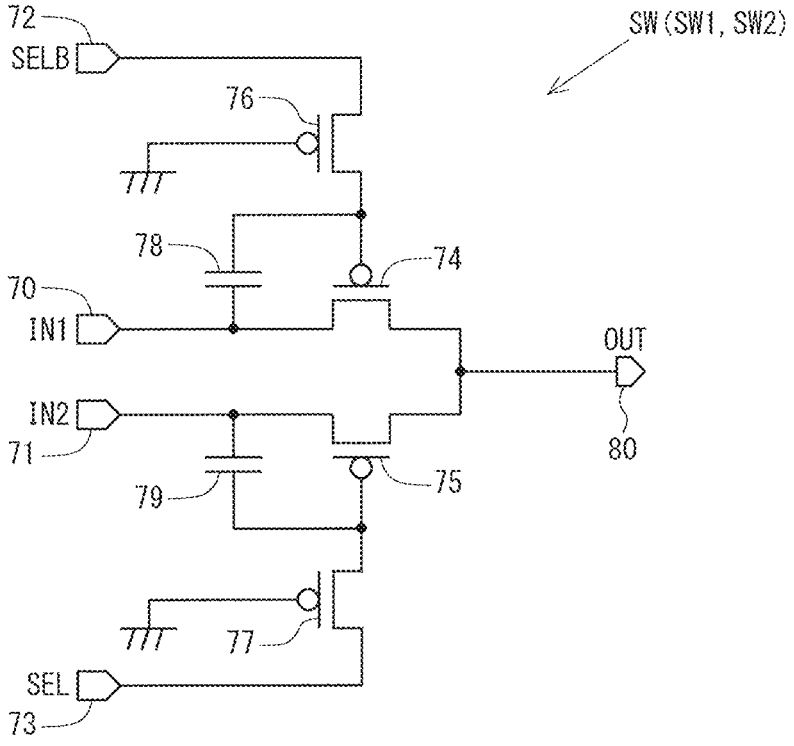
FIG. 16 is a circuit diagram showing a configuration of a switching circuit in a first variant of the embodiment.
Figure 17:
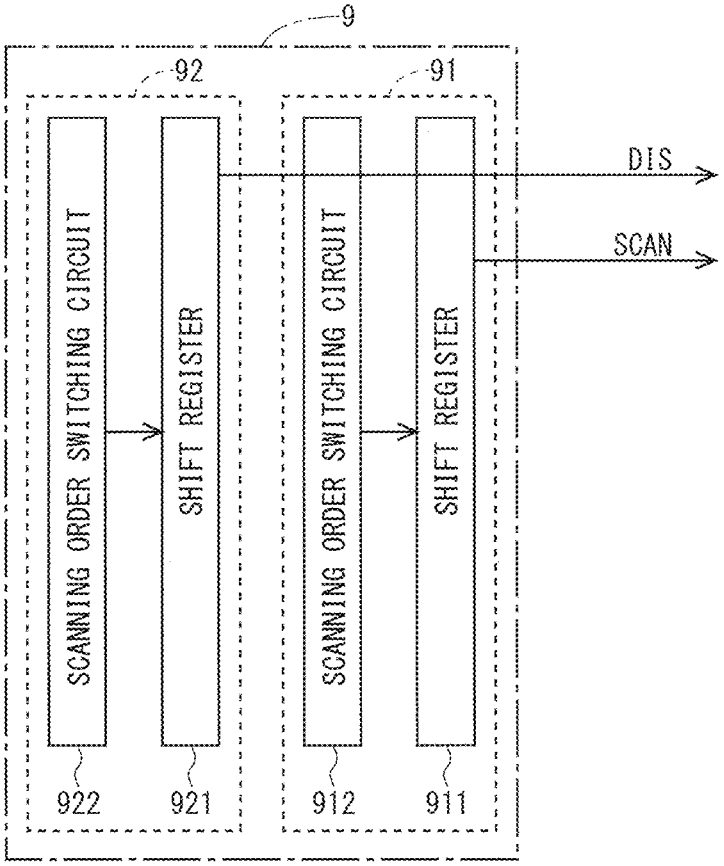
FIG. 17 is a block diagram showing a schematic configuration of a gate driver in a known example.
Figure 18:
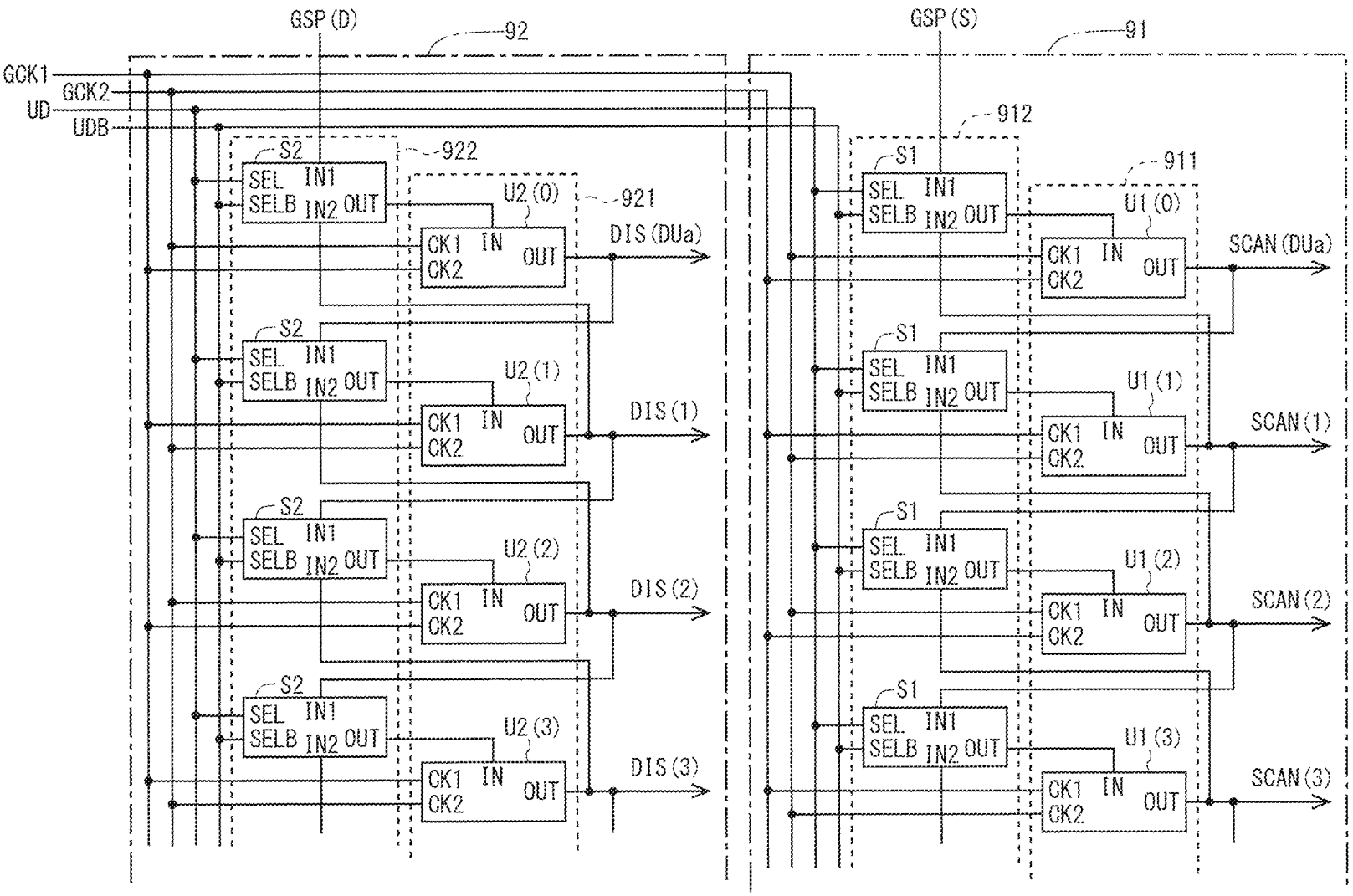
FIG. 18 is a block diagram showing a detailed configuration of the gate driver (configurations of portions of shift registers near their initial stage sides) in the known example.
Figure 19:
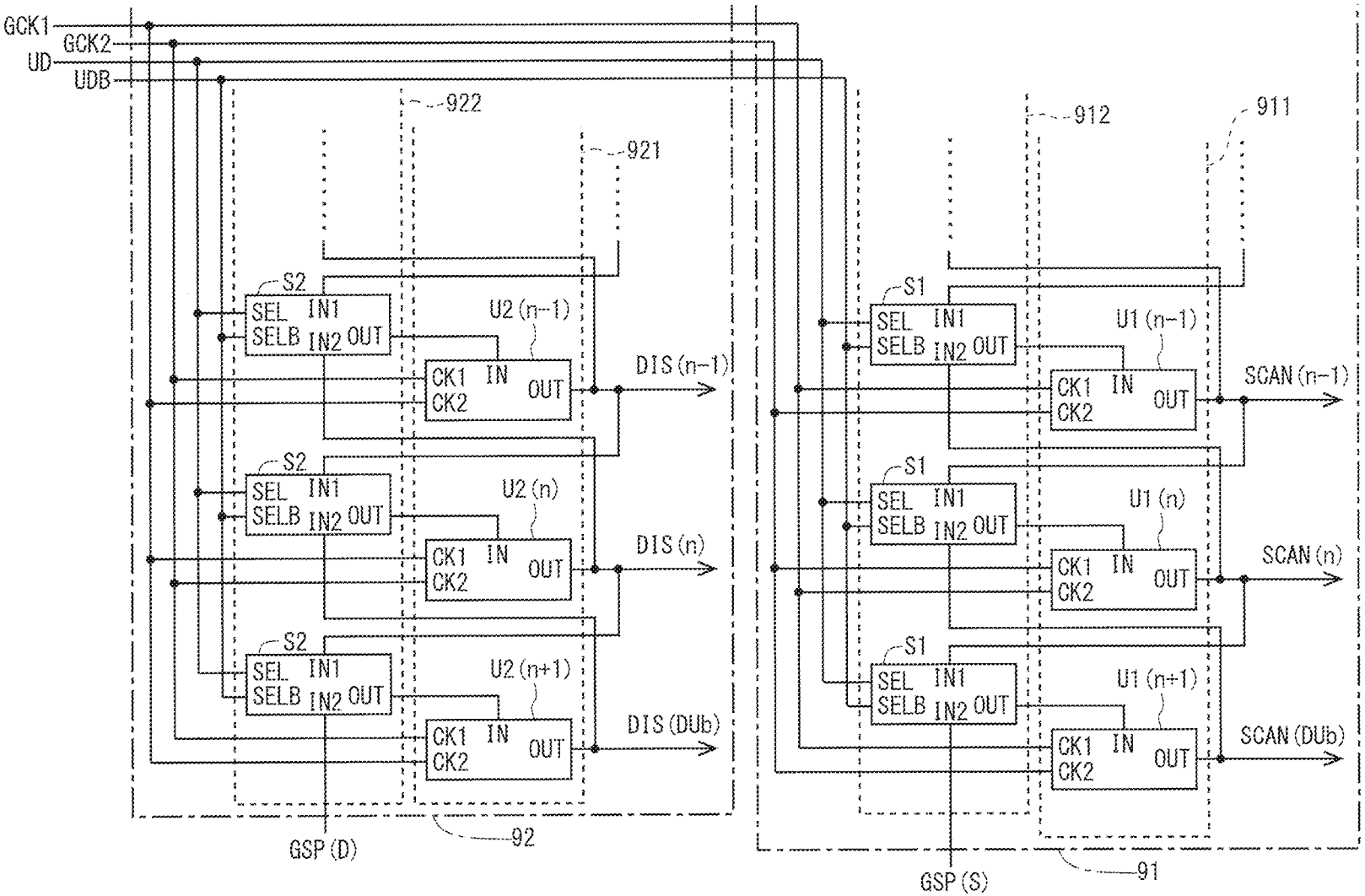
FIG. 19 is a block diagram showing a detailed configuration of the gate driver (configurations of portions of the shift registers near their last stage sides) in the known example.
Figure 20:
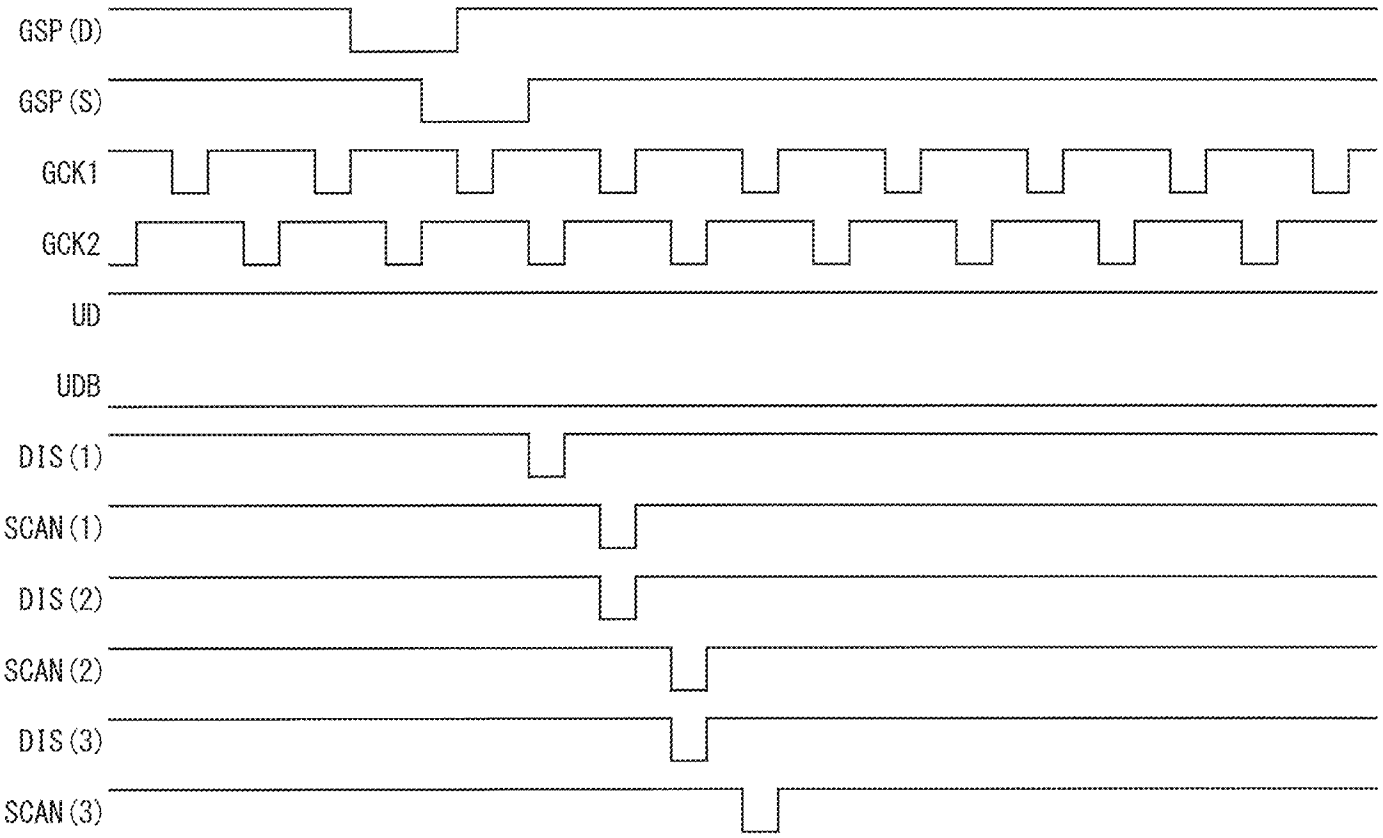
FIG. 20 is a timing chart for describing operation of the gate driver performed when normal order scanning is performed in the known example.
Figure 21:
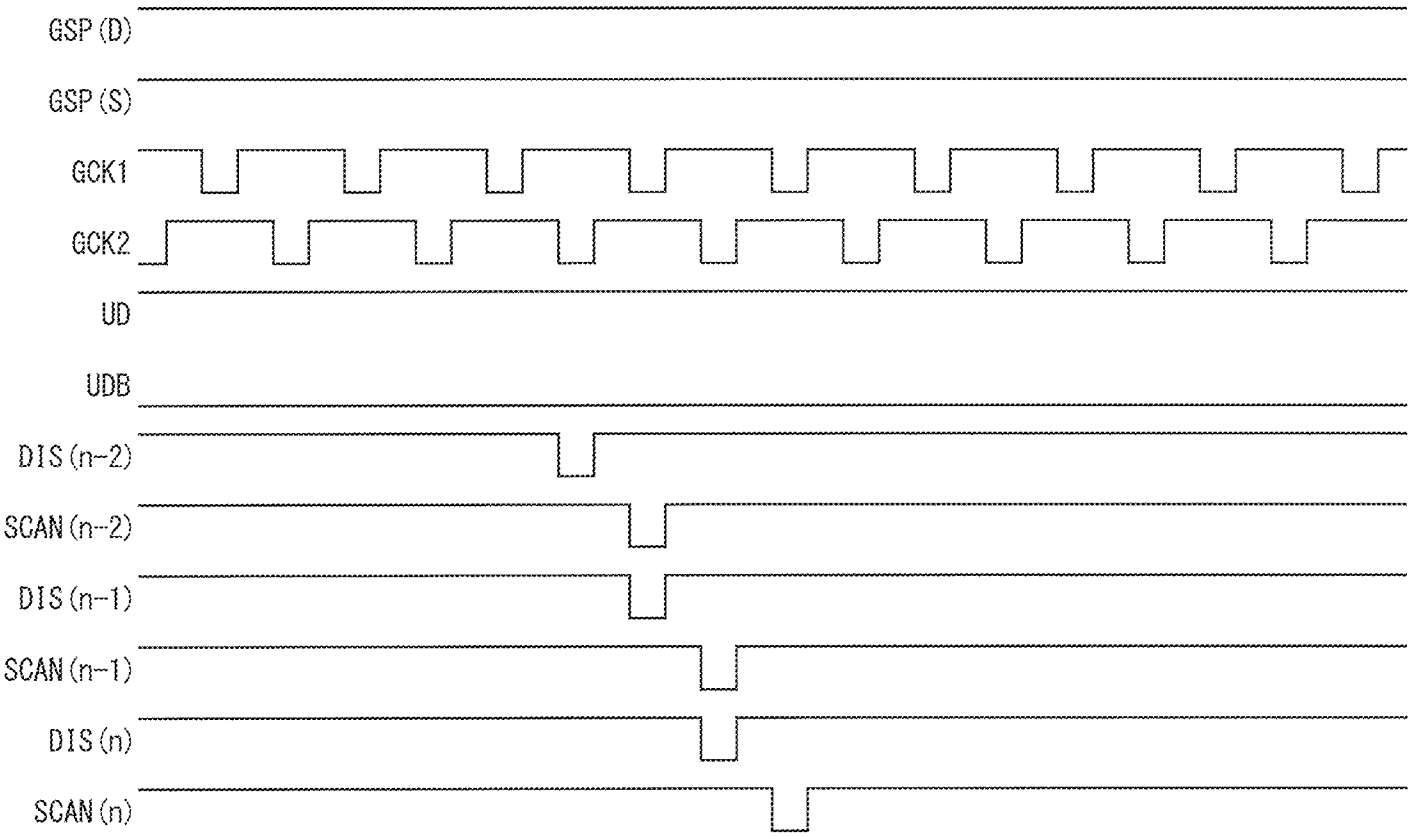
FIG. 21 is a timing chart for describing operation of the gate driver performed when normal order scanning is performed in the known example.
Figure 22:
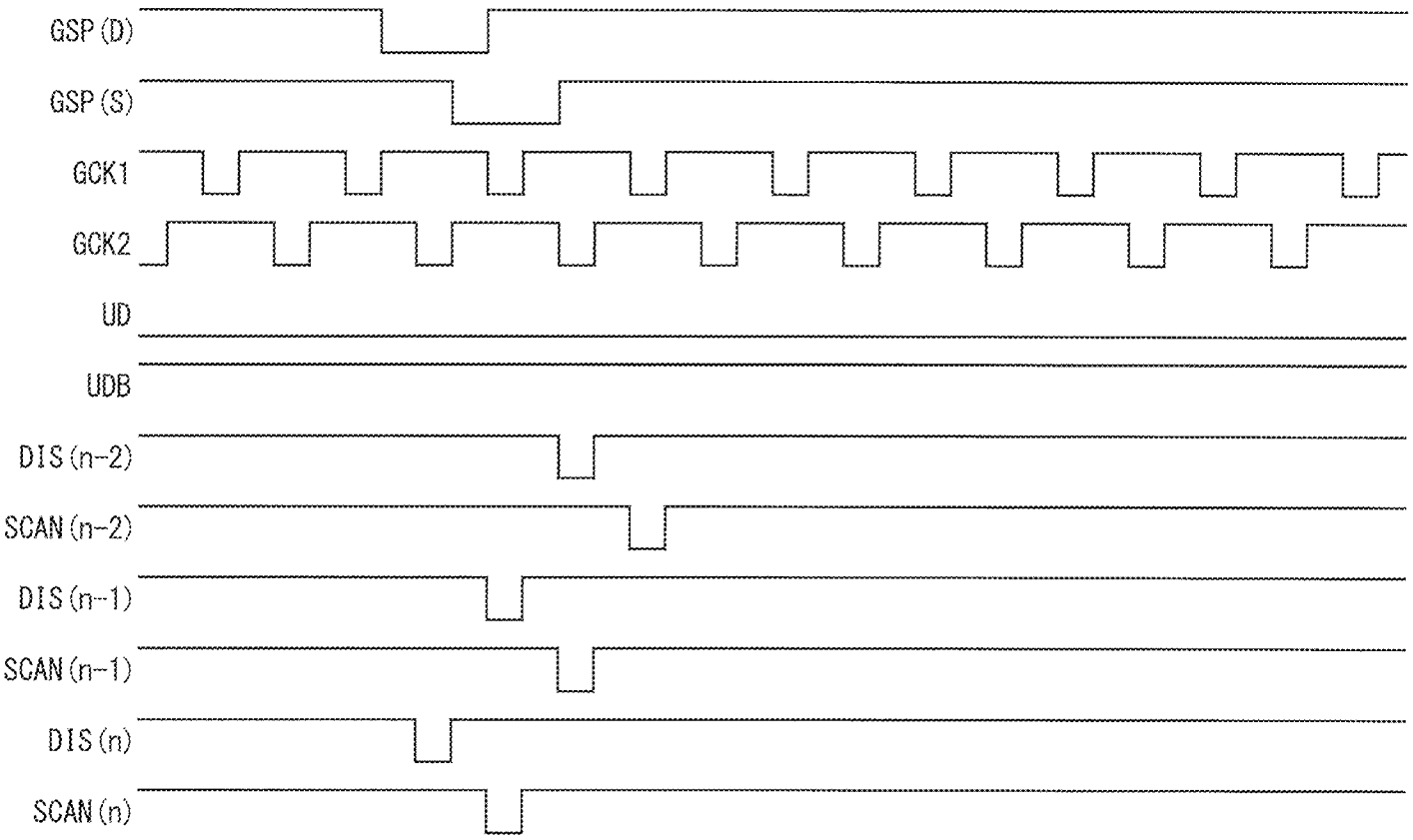
FIG. 22 is a timing chart for describing operation of the gate driver performed when reverse order scanning is performed in the known example.
Figure 23:
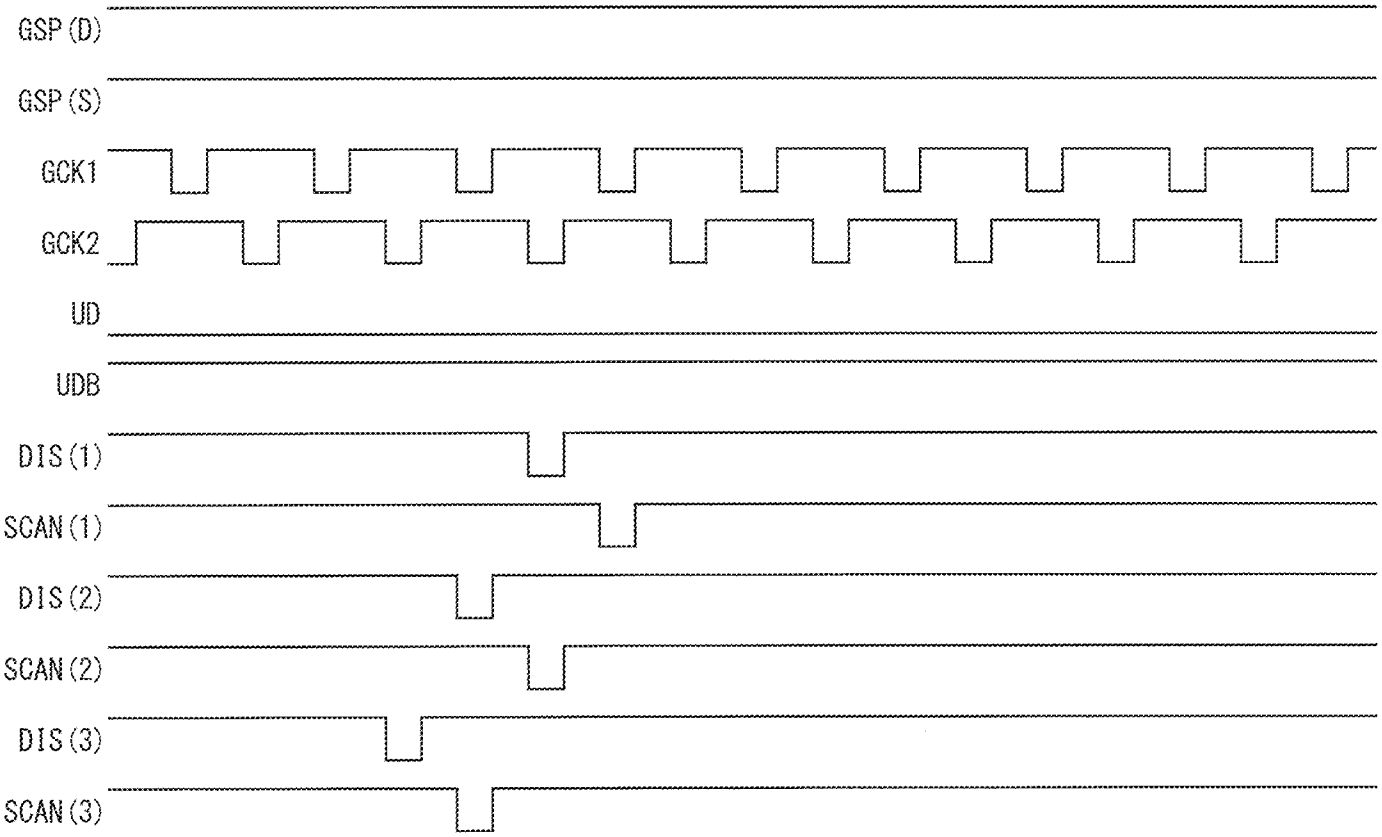
FIG. 23 is a timing chart for describing operation of the gate driver performed when reverse order scanning is performed in the known example.

FIG. 16 is a circuit diagram showing a configuration of a switching circuit SW of the present variant. The switching circuit SW includes four transistors 74 to 77 and two capacitors 78 and 79. The transistors 74 to 77 are P-channel type transistors. The switching circuit SW also has four input terminals 70 to 73 and one output terminal 80. In FIG. 16, an input terminal to which a first input signal IN1 is provided is given reference character 70, an input terminal to which a second input signal IN2 is provided is given reference character 71, an input terminal to which a second selection signal SELB is provided is given reference character 72, and an input terminal to which a first selection signal SEL is provided is given reference character 73.

The transistor 74 is connected at its control terminal to a second conductive terminal of the transistor 76 and a first electrode of the capacitor 78, connected at its first conductive terminal to the input terminal 70 and a second electrode of the capacitor 78, and connected at its second conductive terminal to the output terminal 80. The transistor 76 is grounded at its control terminal, and connected at its first conductive terminal to the input terminal 72 and connected at its second conductive terminal to the control terminal of the transistor 74 and the first electrode of the capacitor 78. The capacitor 78 is connected at its first electrode to the control terminal of the transistor 74 and the second conductive terminal of the transistor 76 and connected at its second electrode to the first conductive terminal of the transistor 74 and the input terminal 70. The transistor 75 is connected at its control terminal to a second conductive terminal of the transistor 77 and a first electrode of the capacitor 79, connected at its first conductive terminal to the input terminal 71 and a second electrode of the capacitor 79, and connected at its second conductive terminal to the output terminal 80. The transistor 77 is grounded at its control terminal, and connected at its first conductive terminal to the input terminal 73 and connected at its second conductive terminal to the control terminal of the transistor 75 and the first electrode of the capacitor 79. The capacitor 79 is connected at its first electrode to the control terminal of the transistor 75 and the second conductive terminal of the transistor 77 and connected at its second electrode to the first conductive terminal of the transistor 75 and the input terminal 71.

When normal order scanning is performed, the first selection signal SEL is maintained at high level and the second selection signal SELB is maintained at low level. By this, the transistor 75 is maintained in off state and the transistor 74 is maintained in on state. In this state, when the first input signal IN1 provided to the input terminal 70 changes from high level to low level, the potential at the control terminal of the transistor 74 significantly decreases due to the presence of the capacitor 78. As a result, a large negative voltage is applied to the control terminal of the transistor 74, sufficiently reducing the potential of an output signal OUT. When reverse order scanning is performed, the first selection signal SEL is maintained at low level and the second selection signal SELB is maintained at high level. By this, the transistor 75 is maintained in on state and the transistor 74 is maintained in off state. In this state, when the second input signal IN2 provided to the input terminal 71 changes from high level to low level, the potential at the control terminal of the transistor 75 significantly decreases due to the presence of the capacitor 79. As a result, a large negative voltage is applied to the control terminal of the transistor 75, sufficiently reducing the potential of the output signal OUT. In the above-described manner, in the present variant, the output signal OUT can obtain substantially equal amplitude to the amplitude of the first input signal IN1 and the second input signal IN2.

According to the present variant, the influence exerted on the amplitude of the output signal OUT by the threshold voltages of the transistors 74 and 75 in the switching circuit SW is small. Hence, occurrence of abnormalities in operation of the circuit is suppressed.

Note that in the present variant, a first transistor is implemented by the transistor 74, a second transistor is implemented by the transistor 75, a third transistor is implemented by the transistor 76, a fourth transistor is implemented by the transistor 77, a first capacitor is implemented by the capacitor 78, a second capacitor is implemented by the capacitor 79, a first input terminal is implemented by the input terminal 70, a second input terminal is implemented by the input terminal 71, a third input terminal is implemented by the input terminal 72, and a fourth input terminal is implemented by the input terminal 73.

<5.2 Second Variant>

In the above-described embodiment, the switching circuits SW (the first switching circuits SW1 and the second switching circuits SW2) have a configuration shown in FIG. 11. In the above-described first variant, the switching circuits SW (the first switching circuits SW1 and the second switching circuits SW2) have a configuration shown in FIG. 16. On the other hand, in the present variant, the first switching circuits SW1 adopt the configuration shown in FIG. 11 and the second switching circuits SW2 adopt the configuration shown in FIG. 16.

The influence exerted on the amplitude of the output signal OUT by the threshold voltages of the transistors 74 and 75 in the configuration shown in FIG. 16 is smaller than the influence exerted on the amplitude of the output signal OUT by the threshold voltages of the transistors 64 and 65 in the configuration shown in FIG. 11. In addition, an output signal OUT from a first switching circuit SW1 is provided to a unit circuit 5, whereas an output signal OUT from a second switching circuit SW2 is provided to an initialization control line DIS. Here, the output signal OUT from the second switching circuit SW2 is directly related to driving of pixel circuits 100, and thus, it is desirable that the amplitude of the output signal OUT be sufficiently large.

Hence, in the present variant, as described above, the second switching circuits SW2 adopt the configuration shown in FIG. 16. In addition, the first switching circuits SW1 adopt, as described above, the configuration shown in FIG. 11 in terms of narrowing a picture-frame by reducing the number of required circuit elements.

<5.3 Third Variant>

In the above-described embodiment, the write control lines SCAN and the initialization control lines DIS are driven such that when normal order scanning is performed, a kth write control line SCAN(k) and a (k+1)th initialization control line DIS(k+1) become active at the same timing, and when reverse order scanning is performed, the kth write control line SCAN(k) and a (k−1)th initialization control line DIS(k−1) become active at the same timing. However, the present disclosure is not limited thereto. For example, the write control lines SCAN and the initialization control lines DIS may be driven such that when normal order scanning is performed, the kth write control line SCAN(k) and a (k+2)th initialization control line DIS(k+2) become active at the same timing, and when reverse order scanning is performed, the kth write control line SCAN(k) and a (k−2)th initialization control line DIS(k−2) become active at the same timing.

Generally describing, the write control lines SCAN and the initialization control lines DIS are driven such that, with P and Q being natural numbers, when normal order scanning is performed, a Pth write control line SCAN(P) and a (P+2)th initialization control line DIS(P+2) become active at the same timing, and when reverse order scanning is performed, the Pth write control line SCAN(P) and a (P−2)th initialization control line DIS(P−2) become active at the same timing. That is, with P and Q being natural numbers, a second switching circuit SW2 connected to a Pth initialization control line DIS(P) applies, based on scanning order instruction signals UD and UDB, an output signal SOUT from a unit circuit 5(P−Q) connected to a (P−Q)th write control line SCAN(P−Q) or an output signal SOUT from a unit circuit 5(P+Q) connected to a (P+Q)th write control line SCAN(P+Q), as a second scanning signal, to the Pth initialization control line DIS(P).

<6. Others>

Although description is made using an organic EL display device as an example in the above-described embodiment and first to third variants, a display device is not limited thereto, and the present disclosure can also be applied to inorganic EL display devices, QLED display devices, etc.

DESCRIPTION OF REFERENCE CHARACTERS

10: DISPLAY UNIT
25 20: PANEL DRIVING UNIT
21: GATE DRIVER
22: EMISSION DRIVER
100: PIXEL CIRCUIT
211: SHIFT REGISTER
30 212: FIRST SCANNING ORDER SWITCHING CIRCUIT

213: SECOND SCANNING ORDER SWITCHING CIRCUIT
SW1: FIRST SWITCHING CIRCUIT (SWITCHING CIRCUIT IN THE FIRST SCANNING ORDER SWITCHING CIRCUIT)
SW2: SECOND SWITCHING CIRCUIT (SWITCHING CIRCUIT IN THE SECOND SCANNING ORDER SWITCHING CIRCUIT)
SCAN: WRITE CONTROL LINE, FIRST SCANNING SIGNAL
DIS: INITIALIZATION CONTROL LINE, SECOND SCANNING SIGNAL
EM: LIGHT EMISSION CONTROL LINE, LIGHT EMISSION CONTROL SIGNAL
UD, UDB: SCANNING ORDER INSTRUCTION SIGNAL
L1: ORGANIC EL ELEMENT
T1: FIRST INITIALIZATION TRANSISTOR
T2: THRESHOLD VOLTAGE COMPENSATION TRANSISTOR
T3: WRITE CONTROL TRANSISTOR
T4: DRIVE TRANSISTOR
T5: POWER SUPPLY CONTROL TRANSISTOR
T6: LIGHT EMISSION CONTROL TRANSISTOR
T7: SECOND INITIALIZATION TRANSISTOR

The invention claimed is:

1. A display device including pixel circuits each including a display element driven by a current, the display device comprising:

a display unit including n first scanning lines; m data signal lines; n×m pixel circuits provided corresponding to intersections of the n first scanning lines and the m data signal lines; and n second scanning lines having one-to-one correspondence with the n first scanning lines, the n and m being natural numbers;

a scanning line drive circuit configured to apply a first scanning signal to the n first scanning lines and apply a second scanning signal to the n second scanning lines, based on scanning order instruction signals that indicate scanning order of the n first scanning lines and the n second scanning lines; and a data signal line drive circuit configured to apply a data signal to the m data signal lines, wherein the scanning line drive circuit includes:

a shift register including a plurality of unit circuits including n unit circuits respectively connected to the n first scanning lines; one or more unit circuits provided at a previous stage side of the n unit circuits; and one or more unit circuits provided at a subsequent stage side of the n unit circuits;

a plurality of first switching circuits respectively corresponding to the plurality of unit circuits; and n second switching circuits respectively connected to the n second scanning lines, with K being a natural number, a first switching circuit corresponding to a unit circuit connected to a Kth first scanning line provides, based on the scanning order instruction signals, an output signal from a unit circuit connected to a (K−1)th first scanning line or an output signal from a unit circuit connected to a (K+1)th first scanning line, as a set input signal, to the unit circuit connected to the Kth first scanning line, each of the unit circuits outputs an output signal based on the set input signal and a clock signal, to each of the first scanning lines there is applied, as the first scanning signal, an output signal from a unit circuit to which the each of the first scanning lines is connected, and with P and Q being natural numbers, a second switching circuit connected to a Pth second scanning line applies, based on the scanning order instruction signals, an output signal from a unit circuit connected to a (P−Q)th first scanning line or an output signal from a unit circuit connected to a (P+Q)th first scanning line, as the second scanning signal, to the Pth second scanning line.

2. The display device according to claim 1, wherein to each of the n first scanning lines there is applied, as the first scanning signal, a signal that controls writing of the data signal to each of the n×m pixel circuits, and to each of the n second scanning lines there is applied, as the second scanning signal, a signal that controls initialization of each of the n×m pixel circuits.

3. The display device according to claim 2, wherein the display unit includes:

a first power line configured to supply a high-level power supply voltage;

a second power line configured to supply a low-level power supply voltage; and an initialization power line configured to supply an initialization voltage, each pixel circuit includes:

a display element having a first terminal and a second terminal and provided between the first power line and the second power line;

a drive transistor having a control terminal, a first conductive terminal, and a second conductive terminal and provided in series with the display element;

a holding capacitor having a first electrode connected to the first power line and a second electrode connected to the control terminal of the drive transistor;

a write control transistor having a control terminal connected to a corresponding first scanning line; a first conductive terminal connected to a corresponding data signal line; and a second conductive terminal connected to the first conductive terminal of the drive transistor;

a threshold voltage compensation transistor having a control terminal connected to the corresponding first scanning line; a first conductive terminal connected to the second conductive terminal of the drive transistor; and a second conductive terminal connected to the control terminal of the drive transistor; and a first initialization transistor having a control terminal connected to a corresponding second scanning line; a first conductive terminal connected to the control terminal of the drive transistor; and a second conductive terminal connected to the initialization power line, and when the data signal is written in each pixel circuit, after a second scanning signal applied to a corresponding second scanning line is brought to on level for a predetermined period, a first scanning signal applied to a corresponding first scanning line is brought to on level for a predetermined period.

4. The display device according to claim 3, wherein the display unit includes n light emission control lines having one-to-one correspondence with the n first scanning lines, the second terminal of the display element is connected to the second power line, and each pixel circuit includes:

a power supply control transistor having a control terminal connected to a corresponding light emission control line; a first conductive terminal connected to the first power line; and a second conductive terminal connected to the first conductive terminal of the drive transistor; and a light emission control transistor having a control terminal connected to the corresponding light emission control line; a first conductive terminal connected to the second conductive terminal of the drive transistor; and a second conductive terminal connected to the first terminal of the display element.

5. The display device according to claim 3, wherein each pixel circuit includes a second initialization transistor having a control terminal connected to a corresponding first scanning line; a first conductive terminal connected to the first terminal of the display element; and a second conductive terminal connected to the initialization power line.

6. The display device according to claim 1, wherein the scanning order instruction signals include a normal order scanning instruction signal and a reverse order scanning instruction signal, when normal order scanning in which the n first scanning lines and the n second scanning lines are sequentially scanned from an upper edge side of the display unit to a lower edge side of the display unit is performed, the normal order scanning instruction signal is maintained at on level and the reverse order scanning instruction signal is maintained at off level, when reverse order scanning in which the n first scanning lines and the n second scanning lines are sequentially scanned from the lower edge side of the display unit to the upper edge side of the display unit is performed, the normal order scanning instruction signal is maintained at off level and the reverse order scanning instruction signal is maintained at on level, both each first switching circuit and each second switching circuit have a first input terminal to which a first input signal is provided; a second input terminal to which a second input signal is provided; a third input terminal to which the normal order scanning instruction signal is provided; a fourth input terminal to which the reverse order scanning instruction signal is provided; and an output terminal, and is configured to output the first input signal from the output terminal when the normal order scanning instruction signal is at on level, and output the second input signal from the output terminal when the reverse order scanning instruction signal is at on level, to a first switching circuit corresponding to a unit circuit connected to a Kth first scanning line there are provided an output signal from a unit circuit connected to a (K−1)th first scanning line as the first input signal, and an output signal from a unit circuit connected to a (K+1)th first scanning line as the second input signal, and to a second switching circuit connected to a Pth second scanning line there are provided an output signal from a unit circuit connected to a (P−Q)th first scanning line as the first input signal, and an output signal from a unit circuit connected to a (P+Q)th first scanning line as the second input signal.

7. The display device according to claim 6, wherein at least either one of each first switching circuit and each second switching circuit includes:

a first transistor having a control terminal connected to the third input terminal; a first conductive terminal connected to the first input terminal; and a second conductive terminal connected to the output terminal; and a second transistor having a control terminal connected to the fourth input terminal; a first conductive terminal connected to the second input terminal; and a second conductive terminal connected to the output terminal.

8. The display device according to claim 6, wherein at least either one of each first switching circuit and each second switching circuit includes:

a first transistor having a control terminal; a first conductive terminal connected to the first input terminal; and a second conductive terminal connected to the output terminal;

a second transistor having a control terminal; a first conductive terminal connected to the second input terminal; and a second conductive terminal connected to the output terminal;

a third transistor having a control terminal; a first conductive terminal connected to the third input terminal; and a second conductive terminal connected to the control terminal of the first transistor;

a fourth transistor having a control terminal; a first conductive terminal connected to the fourth input terminal; and a second conductive terminal connected to the control terminal of the second transistor;

a first capacitor having a first electrode connected to the control terminal of the first transistor; and a second electrode connected to the first conductive terminal of the first transistor; and a second capacitor having a first electrode connected to the control terminal of the second transistor; and a second electrode connected to the first conductive terminal of the second transistor.

9. The display device according to claim 6, wherein the plurality of first switching circuits and the n second switching circuits have a same configuration.

10. The display device according to claim 6, wherein both each first switching circuit and each second switching circuit include:

a first transistor having a control terminal; a first conductive terminal connected to the first input terminal; and a second conductive terminal connected to the output terminal; and a second transistor having a control terminal; a first conductive terminal connected to the second input terminal; and a second conductive terminal connected to the output terminal, in each first switching circuit, the control terminal of the first transistor is connected to the third input terminal, and the control terminal of the second transistor is connected to the fourth input terminal, and each second switching circuit further includes:

a third transistor having a control terminal; a first conductive terminal connected to the third input terminal; and a second conductive terminal connected to the control terminal of the first transistor;

a fourth transistor having a control terminal; a first conductive terminal connected to the fourth input terminal; and a second conductive terminal connected to the control terminal of the second transistor;

a first capacitor having a first electrode connected to the control terminal of the first transistor; and a second electrode connected to the first conductive terminal of the first transistor; and a second capacitor having a first electrode connected to the control terminal of the second transistor; and a second electrode connected to the first conductive terminal of the second transistor.

* * * * *